US009039487B2

(12) United States Patent
Mase et al.

(10) Patent No.: US 9,039,487 B2
(45) Date of Patent: May 26, 2015

(54) BLASTING METHOD AND APPARATUS HAVING ABRASIVE RECOVERY SYSTEM, PROCESSING METHOD OF THIN-FILM SOLAR CELL PANEL, AND THIN-FILM SOLAR CELL PANEL PROCESSED BY THE METHOD

(75) Inventors: Keiji Mase, Tokyo (JP); Shigeru Fujinori, Tokyo (JP)

(73) Assignee: FUJI MANUFACTURING CO., LTD., Tokyo (JP)

( * ) Notice: Subject to any disclaimer, the term of this patent is extended or adjusted under 35 U.S.C. 154(b) by 917 days.

(21) Appl. No.: 12/500,797

(22) Filed: Jul. 10, 2009

(65) Prior Publication Data

US 2010/0035522 A1 Feb. 11, 2010

(30) Foreign Application Priority Data

Aug. 7, 2008 (JP) ..... 2008-204608
Aug. 7, 2008 (JP) ..... 2008-204609

(51) Int. Cl.

| | |
|---|---|
| ***B24C 3/08*** | (2006.01) |
| ***B24C 9/00*** | (2006.01) |
| ***B24C 3/12*** | (2006.01) |
| ***B24C 3/32*** | (2006.01) |
| ***B24C 1/04*** | (2006.01) |
| ***B24C 1/08*** | (2006.01) |

(52) U.S. Cl.
CPC . *B24C 3/322* (2013.01); *B24C 1/04* (2013.01); *B24C 1/086* (2013.01); *B24C 9/003* (2013.01)

(58) Field of Classification Search
USPC ..... 451/38, 39, 40, 81, 87, 89, 90, 102, 456
See application file for complete search history.

(56) References Cited

U.S. PATENT DOCUMENTS

| | | | | | |
|---|---|---|---|---|---|
| 2,448,316 | A | * | 8/1948 | Lesavoy | 425/385 |
| 3,545,996 | A | * | 12/1970 | Duncan | 427/198 |
| 3,715,838 | A | * | 2/1973 | Young et al. | 451/87 |
| 3,906,673 | A | * | 9/1975 | Goto et al. | 451/92 |
| 4,064,661 | A | * | 12/1977 | Maeda | 451/87 |
| 4,175,412 | A | * | 11/1979 | Bernot | 72/40 |
| 4,325,292 | A | * | 4/1982 | McNinney et al. | 451/453 |

(Continued)

FOREIGN PATENT DOCUMENTS

| | | | |
|---|---|---|---|
| JP | 08257913 | A | 10/1996 |
| JP | 09300220 | A | 11/1997 |
| JP | 2007181904 | A | 7/2007 |

*Primary Examiner* — Eileen Morgan
(74) *Attorney, Agent, or Firm* — Cooper Legal Group, LLC

(57) ABSTRACT

Particularly, a thin-film solar cell panel or the like is processed without necessity of attaching and detaching of mask and washing steps with respect to a workpiece in a fine blasting employing a fine abrasive.

A negative pressure space (20) and an opposing negative pressure space (40) having openings (22, 42) are opposed by being spaced at a movement allowable interval of the workpiece such as a thin-film solar cell panel or the like and so as to face one side edge in the same direction as a moving direction of the workpiece. Further, a fine abrasive is injected while relatively moving the workpiece in a moving direction (T) with respect to a blast gun (30) in which an injection hole (31) is disposed within the negative pressure space (20), and the fine abrasive injected into the negative pressure space (20) and/or the opposing negative pressure space (40) and a cut and removed cut scrap such as a thin film layer or the like are sucked and recovered through the intermediary of suction devices (21*a*, 21*b*) and/or an opposing suction device (41) respectively communicating with the spaces (20) and/or (40).

15 Claims, 15 Drawing Sheets

(56) References Cited

U.S. PATENT DOCUMENTS

| | | | | | |
|---|---|---|---|---|---|
| 4,563,840 | A | * | 1/1986 | Urakami | 451/102 |
| 4,600,149 | A | * | 7/1986 | Wakatsuki | 239/120 |
| 4,610,113 | A | * | 9/1986 | Fagerroos | 451/88 |
| 4,825,598 | A | * | 5/1989 | Schlick | 451/87 |
| 4,984,396 | A | * | 1/1991 | Urakami | 451/87 |
| 4,993,200 | A | * | 2/1991 | Morioka et al. | 451/88 |
| 5,018,319 | A | * | 5/1991 | Allard | 451/87 |
| 5,107,629 | A | * | 4/1992 | Boyd et al. | 451/38 |
| 5,177,911 | A | * | 1/1993 | Ruemelin et al. | 451/89 |
| 5,181,348 | A | * | 1/1993 | Roemmele et al. | 451/75 |
| 5,386,668 | A | * | 2/1995 | Mugge et al. | 451/91 |
| 5,417,608 | A | * | 5/1995 | Elliott | 451/81 |
| 5,512,005 | A | * | 4/1996 | Gulling | 451/29 |
| 5,556,324 | A | * | 9/1996 | Shank, Jr. | 451/89 |
| 5,667,429 | A | * | 9/1997 | Uchida et al. | 451/87 |
| 5,667,430 | A | * | 9/1997 | McPhee et al. | 451/87 |
| 5,709,590 | A | * | 1/1998 | McPhee et al. | 451/87 |
| 5,833,521 | A | * | 11/1998 | McPhee et al. | 451/87 |
| 5,957,761 | A | * | 9/1999 | Miller et al. | 451/92 |
| 6,012,975 | A | * | 1/2000 | Jager | 451/87 |
| 6,099,395 | A | * | 8/2000 | Guseman | 451/75 |
| 6,273,154 | B1 | * | 8/2001 | Laug | 141/97 |
| 6,390,898 | B1 | * | 5/2002 | Pieper | 451/75 |
| 6,431,965 | B1 | * | 8/2002 | Jones et al. | 451/89 |
| 6,656,017 | B2 | * | 12/2003 | Jackson | 451/39 |
| 7,182,671 | B1 | * | 2/2007 | Shimizu et al. | 451/8 |
| 7,226,343 | B2 | * | 6/2007 | Bohler | 451/90 |
| 7,249,994 | B2 | * | 7/2007 | Sommacal | 451/89 |
| 8,128,460 | B2 | * | 3/2012 | Voges et al. | 451/38 |
| 8,328,603 | B2 | * | 12/2012 | Jung et al. | 451/81 |
| 8,562,393 | B2 | * | 10/2013 | Giovanardi | 451/81 |
| 2001/0051493 | A1 | * | 12/2001 | Kelton et al. | 451/36 |
| 2003/0134574 | A1 | * | 7/2003 | Uziel | 451/39 |
| 2005/0205531 | A1 | * | 9/2005 | Iizuka | 219/121.18 |
| 2010/0122719 | A1 | * | 5/2010 | Mase et al. | 136/244 |
| 2010/0130110 | A1 | * | 5/2010 | Giovanardi | 451/81 |
| 2010/0173569 | A1 | * | 7/2010 | O'Neill et al. | 451/89 |
| 2012/0186520 | A1 | * | 7/2012 | Hill | 118/713 |
| 2012/0301643 | A1 | * | 11/2012 | Aadland et al. | 428/34.1 |

* cited by examiner

BLASTING METHOD AND APPARATUS HAVING ABRASIVE RECOVERY SYSTEM, PROCESSING METHOD OF THIN-FILM SOLAR CELL PANEL, AND THIN-FILM SOLAR CELL PANEL PROCESSED BY THE METHOD

BACKGROUND OF THE INVENTION

1. Field of the Invention

The present invention relates to a blasting method and apparatus provided with an recovery system for abrasives used the blasting process, and more particularly to a blasting method including a recovery method of the abrasives, especially fine particle abrasives as a system for recovering the abrasives in the blasting and a blasting apparatus used for this processing, the blasting apparatus provided with an abrasive recovery system executing the method.

In more detail, the present invention relates to a blasting method and a blast processing apparatus (hereinafter, referred to as "blasting apparatus") which can prevent fine abrasives (hereinafter, referred to as "abrasives") and cut scraps including crushed abrasives by the blasting process from being attached to an article to be processed (hereinafter, referred to as "workpiece"), which is preferably adapted to a so-called blasting using the abrasives, and a thin-film solar cell panel in accordance with the processing method.

Further, the inventor of the present invention focused on the blasting process which has not been suggested, tried, experimented or exemplified as a means which might be applied in a scribing method for the thin-film solar cell panel. More detailedly, in the present invention, it is intended to provide a blasting method including a recovery step of fine abrasives and cut scraps without any mask (a cover fixed on a surface to preventing a part of the predetermined surface from processing) as well as a cleaning process of the workpiece after the blasting process by a blasting apparatus provided with an abrasive recovery system which is preferably used for a processing of the thin-film solar cell panel.

In the present invention, a concept of the abrasives includes a coarse particle as well as the fine particle. In JISR6001, a particle size distribution of the coarse particle is defined, and the particle size distribution up to the particle size F60 (indicated so in JIS) can be used. A typical particle size in F60 is 230 μm, however, hereinafter, the fine particle means a particle of #400 or more, or a particle with an average particle diameter 30 μm or less.

2. Description of the Related Art

As a processed example of the workpiece, there is experimentally referred to a gravity type blasting apparatus 60 which has not been conventionally employed, and a description will be given of it with reference to FIG. 7. The blasting apparatus is provided with a cabinet 61 forming a processing chamber inside thereof, for processing the workpiece (not shown) carried in the cabinet 61 through the intermediary of a carry-in port 63 by disposing a blast gun 62 having an ejection nozzle 62 within the cabinet.

In general, a recovery cycle of the abrasive in the blasting apparatus is configured as follows. That is, a lower portion of the cabinet 61 is formed into an inverse pyramid shape, a hopper 68 is formed at the lower portion, and a lowest end of the hopper 68 is communicated with an upper portion of a recovery tank 70 for recovering the abrasives, installed at an upper portion of the cabinet 61 through the intermediary of a conduit 65.

Further, the recovery tank 70 mentioned above is a so-called cyclone for separating the cut scraps from the abrasives. If a leading end of the conduit 65 is connected to an inflow port 73 of the recovery tank 70 through the intermediary of a communication pipe 75, and an inside of the recovery tank 70 is sucked by a dust collector (not shown) provided with a wind discharging machine through the intermediary of a connecting pipe 74 and a discharge pipe 67, the abrasives and the cut scraps within the cabinet has been transferred into the recovery tank 70 together with an air current through the intermediary of the communication pipe 75, the cut scraps are recovered by the dust collector at a time of falling down while turning along an inner wall of the recovery tank 70, and the reusable abrasives are collected in a bottom portion of the recovery tank 70 and pressure-fed to the blast gun 62 having an ejection nozzle 62 through the intermediary of an abrasive feeding pipe 64.

As mentioned above, the reusable abrasives can be ejected by the ejection nozzle of the blast gun together with the newly charged abrasives as occasion demands.

Thereafter, the recovering cycle mentioned above is repeated.

As mentioned above, in the conventional blasting apparatus, the abrasives ejected within the processing chamber is fed into the recovery tank 70 by a negative pressure generated by the dust collector, then recovered. However, in the case of using the fine particle having a small particle diameter, since a surface area of each fine abrasives are larger with respect to its weight in comparison with a general abrasive, the fine abrasives have a property tending to firmly attaching or agglutinating to the workpiece or the like. Accordingly, once the fine abrasives are attached to the workpiece and the inner wall of the processing chamber, it is hard to remove it even if an inside of the processing chamber is sucked by the negative pressure or an air blowing or the like is applied to the workpiece.

Accordingly, the workpiece to which the blasting is applied by such fine abrasive requires a step for removing the fine abrasives attached to a surface thereof by cleaning it with a washing water after the blasting.

As mentioned above, in the blasting using the fine abrasive, taking into consideration the fact that once the fine abrasives are attached to the workpiece or the like, it is hard to remove it, there has been proposed to recover the fine abrasives before they are attached to the workpiece or the other places.

As one example of such structure, in a blasting apparatus 80 shown in FIG. 8, it has been proposed that one end of a processing duct 81 is provided with a blast gun 91 having an ejection nozzle 91 ejecting abrasives, the other end of the processing duct 81 is communicated with a suction duct 83 sucking abrasives by a negative pressure, the processing duct 81 is provided with a blast chamber 82 in a front side of an ejection current of the abrasives, a side wall of the blast chamber 82 is provided with an insertion port 84 inserting a workpiece W in a direction which is approximately orthogonal to the ejection current of the abrasives, and an intake port 85 as an intake gap for sucking an ambient air is formed between an inner periphery of the insertion port 84 and an outer periphery of the workpiece W, whereby the fine abrasives ejected to the workpiece in the blast chamber is immediately sucked from the suction duct, and the abrasives are prevented from scattering to the processing chamber by an air blow generated by the ambient air sucked from the intake gap (see Japanese Patent LOPI No. H09-300220).

In this case, since the blasting using the fine abrasive can be carried out at a high precision, it can be expected to be utilized in various fields. As one example, there can be considered a utilized field which is substitute for the currently utilized laser processing in a scribing (a fluting) carried out in a manufacturing step of a thin-film solar cell panel.

In this case, the scribing carried out in the manufacturing step of the thin-film solar cell panel is generally carried out by the laser at the present, however, as shown in FIGS. 9A and 9B, it is required a step for removing a thin film layer from a glass substrate in a range of width within several mm to ten and several mm in a peripheral edge portion, before attaching a glass cover after forming thin film layers such as a back electrode, a light absorbing layer, an emitter, a transparent electrode and the like which are required for the thin-film solar cell, on the glass substrate. Therefore, even in the case that a metal frame made of aluminum or the like is attached to the peripheral edge portion after attaching the glass cover, it is possible to prevent a short circuit between the metal frame and the peripheral edge by removing the thin film layer at the peripheral edge portion as mentioned above.

In this case, the scribing by means of the laser carried out in the manufacturing step of the thin-film solar cell panel is also carried out in the case of dividing the thin-film solar cell panel into each of the cells as well as the example mentioned above.

The laser processing apparatus mentioned above is expensive, a lot of initial investment is necessary, and a comparatively high running cost is required because a nitrogen gas is consumed in a nitrogen gas laser which is generally used for this kind of work.

Accordingly, if the scribing mentioned above can be carried out by a blasting apparatus which is inexpensive in comparison with the laser apparatus and a method called as a blasting which can comparatively hold down the running cost, it is advantageous in a cost competitive power in a market.

However, in the case that the scribing mentioned above is carried out by the blasting using the fine abrasives, since the ejected abrasives are attached to the workpiece, it is necessary to remove the abrasives attached as mentioned above, however, the fine abrasives are hard to be removed once it is attached to the workpiece, as mentioned above, and can not be easily removed by sucking the processing chamber by means of the dust collector or applying the air blow to the workpiece.

Accordingly, if the fine abrasives attached to the workpiece as mentioned above is going to be removed, it is required to wash the workpiece with water or the like after the blasting, however, in the case that the workpiece is the thin-film solar cell mentioned above, it is impossible to wash it with the washing water, and there has been no effective means for removing the fine abrasives attached thererewith.

Further, in the case of carrying out the cut by the blasting apparatus, since the abrasives ejected by an ejection hole of a blast gun bombarded onto the workpiece as shown in FIG. 10, and diffuses to all the directions, such as, 360 degree along a surface of the workpiece together with the air current feeding the abrasives, the workpiece is cut not only in a surface on which bombarded with the abrasives but also in the periphery.

Accordingly, if the scribing as mentioned above is going to be carried out by the blasting, it is necessary to previously protect the surface of a non-cut portion by sticking the mask material on the surface in such a manner that the surface to be left without being removed is not cut.

However, in the case that the thin-film solar cell panel mentioned above is employed as the workpiece, each of the layers formed on the glass substrate is comparatively brittle, and there is a risk that the thin film layer is peeled off from the glass substrate due to a shock at a time of sticking and peeling a mask material, when it is stuck or peeled off after processed.

As mentioned above, in the blasting using the fine abrasives, since the abrasives are firmly attached to the workpiece so as to be hard to be removed, and it is necessary to stick the mask material for defining the cut range, the blasting can not be applied to the workpiece which can neither washed nor stuck by the mask material such as the thin-film solar cell panel, in spite that it is excellent in terms of the cost in comparison with the scribing by the laser.

In this case, in the apparatus brought on as '300220 mentioned above, it is intended to recover the fine abrasives before they are attached to the workpiece, however, the workpiece which is applicable here is limited to a cylindrical-shaped workpiece or a linear workpiece, on the basis of a structure shown in FIG. 8, and can not be applied, for example, to a plate-like two-dimensional workpiece vertically separates the processing chamber into two.

Further, in the structure described in '300220 mentioned above, it is essential to stick the mask material if it is intended to form a groove having a fixed width with respect to the workpiece, and it is impossible to use for the scribing of the thin-film solar cell panel in this regard.

In this case, in the present specification, a description will be given by exemplifying the thin-film solar cell panel formed into the plate-like two-dimensional shape as one example of the workpiece, however, the same problem mentioned above is generated even in the workpiece made of various materials which can neither be washed with the washing water nor be stuck by the mask material, without being limited thereto.

Further, even in the workpiece which can be washed and stuck by the mask material, there is an advantage that productivity is improved and a working cost can be reduced as far as it is possible to omit the washing and the sticking of the mask.

As the foregoing, there is a serious defect that the abrasives or the like can not be peeled off and fallen away by an after blow and a water washing is required once the abrasives or the like is attached to a surface to be processed of the workpiece W in the related art mentioned above.

Accordingly, an object of the present invention is to overcome the above disadvantage in providing a blasting method and a blasting apparatus including an abrasive recovery system which can easily recover the abrasives or the like before being attached to the workpiece even in the case of using the fine abrasives, accordingly can make the step of the (water) washing or the like for removing the fine abrasives after the blasting unnecessary without generating the attachment thereof, and can carry out a fluting or the like at a fixed cut width without sticking a mask material to the workpiece which is moved relatively.

SUMMARY OF THE INVENTION

In the following explanation of the summary, reference numerals are referred as of the Embodiment in order to easily read the present invention, however, these numerals are not intended to restrict the invention as of the Embodiment.

The present invention can be more effectively used in the case of carrying out a cutting process at a predetermined width to a workpiece, particularly formed into a plate-like two-dimensional shape, without being limited thereto, and can be utilized as a substitute for a laser used for various etching and processing, for example, scribing a thin-film solar cell panel which has been conventionally carried out by the laser because it is unnecessary to carry out a step of sticking a mask material for limiting a cut range, washing by means of a washing liquid for removing the attached fine abrasives or the like.

Basic structure, operation and effect of the present invention will be apparent from the following description.

In order to achieve the object mentioned above, a processing method including an abrasive recovery system in a blasting according to a first aspect of the present invention is characterized by;

providing an upper housing member 12 having a space 20 inside and an opening 22 communicating with said space 20 at a bottom face thereof;

positioning said upper housing member 12 above a workpiece W, so as to arrange the opening 22 of the upper housing member 12 facing toward a surface of said workpiece W, and to make a predetermined clearance between the bottom face of the upper housing member 12 and the surface of said workpiece W;

providing a blast gun 30 to the upper housing member 12 so as to point the blast gun at the surface of the workpiece W to be processed through said opening 22 of said upper housing member 12, and to make a predetermined clearance between the blast gun 30 and the surface of the workpiece W to be procsesed;

moving the workpiece W with respect to the blast gun 30 (in a moving direction marked T);

ejecting a mixed fluid of a compressed gas and abrasives to said surface of the said workpiece W to be processed from an ejection hold 31 of blast gun 30; and sucking the space 20 in the upper housing member 12 by a suction means to make the space 20 negative pressure for and recovering cut scraps of said workpiece W and the abrasives from said surface of said workpiece W through the opening 22 and the space 20 of said upper recovering member 12.

Further, in the method, it is preferable that providing a lower housing member 14 having a space 40 inside and an opening 42 communication with said space 40 at a top face thereof;

positioning said lower housing member 14 under the workpiece W, so as to arrange the opening 42 of the lower housing member 14 facing toward the opening 22 of said upper housing member 12 through said workpiece W, and to make a predetermined clearance between the top face of the lower housing member 14 and a back surface of said workpiece W;

sucking the space 40 in said lower housing member 14 by said suction means to make the space 40 negative pressure for recovering cut scraps and abrasives through the opening 42 and the space 40 of said lower recovery member 14.

In accordance with the structure mentioned above, it is possible to securely recover the fine abrasives at a time when it is in a floating state before being attached to the workpiece W, by carrying out in the space 20 in said upper housing member 12 and/or the space 40 in said lower housing member 14 under the negative pressure. As a result, the removing work of the fine abrasives which has been conventionally removed by washing by means of the washing water is made redundant, and even if the workpiece to be processed has such a property as the thin-film solar cell panel or the like on which washing can not be conducted, it is possible to employ such workpiece as the subject of the blasting using the fine abrasives.

Further, insides of both the space 20 in said upper housing member 12 and the space 40 in said lower housing member 14 are sucked then the suction force applied to the workpiece W caused by the suction within the space 20 in said upper housing member 12 is suppressed by the suction force applied to the workpiece W caused by the suction within the space 40 in said lower housing member 14, thereby the workpiece W is relatively moved smoothly.

Further, it is possible to preferably recover the ejected fine abrasives even in the case that the workpiece W is not disposed between both the space 20 in said upper housing member 12 and the space 40 in said lower housing member 14 by sucking through the intermediary of the space 40.

Preferably, the ejection hole 31 of the blast gun 30 having the an elongated rectangular cross sectional shape is disposed proximity to the said surface of said workpiece to be processed and the ejecting direction of said blast gun 30 is approximately vertical to the workpiece, then the mixed fluid of the compressed gas and the abrasives are ejected in an elongated rectangular shape according to the cross sectional shape of the ejection hole 31, and the space 20 in the upper housing member 12 is sucked from both sides of an open width $W_0$ of said ejection hole 31.

In accordance with the structure mentioned above, it is possible to create the diffusing direction of the abrasives ejected and bombarded onto the workpiece W in the direction of the opening width $W_0$ of the ejection hole 31, and it is possible to process the workpiece W at the cutting width corresponding to the opening length $L_0$ of the ejection hole 31 without sticking the mask material. Further, it is possible to prevent the fine abrasive from being attached to the surface of the workpiece W.

In accordance with the structure mentioned above, in the structure in which the ejection hole 31 of the blast gun 30 as an ejection nozzle is formed into the elongated rectangular shape, it is further possible to achieve the relative movement of the workpiece W with respect to the ejection hole 31 in the direction of the opening width $W_0$ of the ejection hole 31.

In accordance with the structure mentioned above, it is possible to apply the blasting using the fine abrasives even to the workpiece to which the mask material can not be stuck, and in the case of applying the blasting to the other workpieces, it is possible to achieve a reduction of a labor and a material which are expended in the sticking and the washing of the mask material.

Further, it is possible to apply the blasting at the high precision processing width to the workpiece W without using the mask material, by aligning the relative moving direction T of the workpiece W and the direction of the opening width $W_0$ of the ejection hole 31.

Further, it is possible to securely prevent the ejected abrasives from diffusing in the direction of the opening length $L_0$ of the ejection hole 31 after being bombarded onto the workpiece W, by setting the opening width $W_0$ of the ejection hole 31 of the blast gun 30 to a range within 0.1 mm to 100 mm, preferably 0.1 mm to 30 mm, whereby it is possible to precisely control the cut width of the workpiece W.

Further, it is preferable that the axial direction of the suction devices 21*a* and 21*b* with respect to the surface to be processed of the workpiece W is set to an inclination angle θ within 10 to 80 degree.

In accordance with the structure mentioned above, it is possible to more efficiently recover the fine abrasives caused by sucking the inside of the space 20 in the upper housing member 12.

Further, in the blasting method, a rectifying plate 24 may be provided within the opening 22 of the upper housing member 12 at both sides of the ejection hole 31 of said blast gun and symmetrically inclined at a constant angle for deflecting a flow of abrasives along a surface of said workpiece so that said flow of said abrasives are moved away from said surface of said workpiece.

It is possible to deflect the flow of the abrasives flowing along the surface of the workpiece W to the direction moving away from the surface of the workpiece W by the rectifying plate 24, whereby it is possible to improve a recovery efficiency by the suction devices 21*a* and 21*b* so as to further securely prevent the fine abrasives from being attached to the workpiece W.

Further, a blasting apparatus provided with a recovery system serving as an abrasive recovery system according to the present invention for achieving the method mentioned above comprises:

an upper housing member 12 having a space 20 inside, an opening 22 communicating with said space 20 at a bottom face thereof, and a suction device 21 (21*a*,21*b*) of which one end communicating with said space 20 in said upper housing member 12;

said upper housing member 12 positioned above a workpiece W so as to arrange the opening 22 of the upper housing member 12 facing toward a surface of said workpiece W, and to make a predetermined clearance between the bottom face of the upper housing member 12 and the surface of said workpiece W;

a blast gun 30 being provided to said upper housing member 12, so as to point at the surface of the workpiece W to be processed through said opening 20 of said upper housing member 12, and to make a predetermined clearance between the blast gun 30 and the surface of the workpiece W to be processed;

said blast gun 30 ejecting a mixed fluid of a compressed gas and abrasives to said surface of said workpiece W being provided so as to be moved relatively with respect to said blast gun 30; and a suction means for example, a dust collector, communicating with the other end of said suction device 21(21*a*,21*b*) sucking said space 20 in said upper recovering member 12 to make the space 20 negative pressure, and recovering cut scraps of said workpiece and abrasives from said surface of said workpiece W.

In the blasting apparatus having the structure mentioned above, further comprising a lower housing member 14 having a space 40 inside, an opposing 42 communicating with said space 40 on a top face thereof, and a suction device 41 of which one end communicating with said space 40 in said lower housing member 14, and the other end communicating with said suction means;

said lower housing member 14 positioned under the workpiece W, so as to arrange the opening 42 of the lower housing member 14 facing toward the opening 20 of said upper housing member 12 through said workpiece W, and to make a predetermined clearance between the top face of the lower housing member 14 and a back surface of said workpiece W;

sucking said pace in said lower housing member by said suction means communicating with the other end said suction device to make the space negative pressure, and recovering cut scraps of said workpiece and abrasives from said workpiece through said upper housing member and lower housing member.

Further, it is possible to employ the method of the present invention instead of the conventional laser processing which requires the huge initial investment and the expensive running cost, by employing a thin-film solar cell panel having thin film layers such as a back electrode, a light absorbing layer, an emitter, a transparent electrode and the like which are required for the thin-film solar cell, on the glass substrate as the subject to be processed, and sucking and recovering the thin film layer and the abrasive which are cut and removed from the glass substrate, from the space in the upper housing member or the space in the lower housing member. It is possible to employ the method of the present invention instead of the conventional laser processing even in the case that the thin-film solar cell panel is divided into each of the cells.

BRIEF DESCRIPTION OF THE DRAWINGS

The objects and advantages of the invention will become apparent from the following detailed description of preferred embodiments thereof provided in connection with the accompanying drawings in which:

FIGS. 2A and 2B are explanatory views explaining a relation between an elongated rectangular ejection hole provided in a blast gun and a flow of abrasives, in the abrasive recovery system according to the present invention, in which FIG. 2A is a plan view and FIG. 2B is an observation according to a perspective view;

FIGS. 3A, 3B, 3C and 3D are explanatory views explaining a positional relationship of each of devices in the abrasive recovery system according to the present invention, in which FIG. 3A is an explanatory view explaining a disposition example of the elongated rectangular ejection hole provided in the blast gun and a workpiece, FIG. 3B is an explanatory view of a disposition of an opening 22 of an upper housing member 12 and the workpiece in a bottom elevational view and a positional relationship of a recovery opening 22' formed thereby, FIG. 3C is an explanatory view of a disposition of an opening 42 of a lower housing member 14 and the workpiece in a plan view and a positional relationship of a recovery opening 42' formed thereby, and FIG. 3D is a schematic front view in the abrasive recovery system according to the present invention;

FIGS. 6A and 6B are explanatory views of a processed example using the abrasive recovery system according to the present invention, in which FIG. 6A shows a processed example applied to four sides of a plate-like two-dimensional workpiece, and FIG. 6B shows a processed example applied to two sides and a center of the plate-like two-dimensional workpiece;

FIGS. 9A and 9B are explanatory views of a scribing with respect to a thin-film solar cell panel, in which FIG. 9A is an explanatory view of a device carrying out the scribing, and FIG. 9B is an explanatory view of a layer removed by the scribing.

DETAILED DESCRIPTION OF THE PREFERRED EMBODIMENTS

Figure 1:
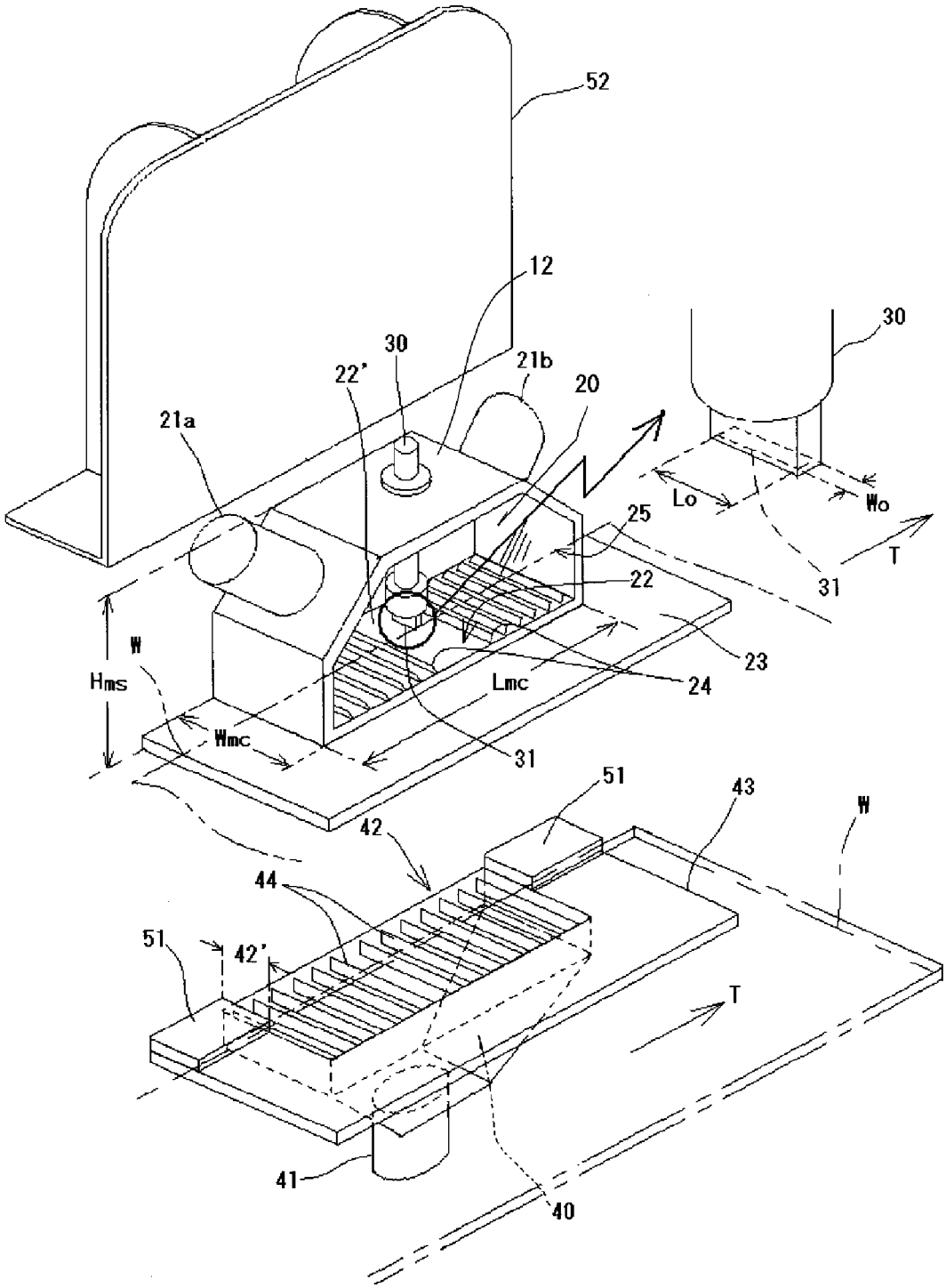
FIG. 1 is a schematic perspective view of an abrasive recovery system in a state in which an upper housing member and a lower housing member are vertically separated in the abrasive recovery system according to a first embodiment of the present invention.

Next, an embodiment according to the present invention will be described with reference to the accompanying drawings.

Abrasive Recovery System

An embodiment of an abrasive recovery system (hereinafter, simply referred to as "recovery system" in the embodiment) according to the present invention used for a blasting is shown in FIGS. 1 to 6.

As shown in the drawings, the recovery system 10 according to the present invention is provided, for example, with an upper housing member 12 having a space 20 inside positioned above a surface to be processed of a plate-like two-dimensional workpiece W being provided each other at a predetermined clearance, a blast gun 30 is provided in the upper housing member 12, and suction means sucking an inside of the space 20 in the upper housing member 12 through suction devices 21*a* and 21*b* (hereinafter, simply referred to as "suction device 21" in the case of indicated the both) communicating with said space 20.

In the illustrated embodiment, there can be provided a lower correcting member 14 having space 40 inside positioned under an opposite surface (hereinafter, referred to as "back face") to the surface to be processed of the workpiece W being provided each other at a predetermined clearance, in addition to the space 20 in the upper housing member 12, the space 40 in the lower housing member 14 can be opposed to the space 20 in the upper housing member 12 through the intermediary of the workpiece W, and there can be provided with an suction device 41 through which said suction means sucking an inside of the lower housing member 14. However, the lower housing member 14 can be omitted so as to construct the recovery system 10.

Upper Housing Member 12

The upper housing member 12 mentioned above which is positioned above the surface to be processed of the plate-like two-dimensional workpiece (hereinafter, simply referred to as "workpiece") being provided each other at the predetermined clearance is disposed between a bottom face of the upper housing member 12 and a top face of the horizontally arranged workpiece W in the illustrated embodiment, and provided with an opening 22, in this embodiment a rectangular opening 22 whose longitudinal direction is positioned in the same direction of a moving direction of the workpiece.

In the illustrated embodiment, the upper housing member 12 space 20 is formed in a rectangular shape having a length $L_{mc}$ direction (a longitudinal direction) in a moving direction T of the workpiece W which is the subject to be processed in a plan view and a width $W_{mc}$ direction in an orthogonal direction to the moving direction T as shown in FIG. 1. The upper housing member 12 includes the opening 22 at a bottom face thereof, and the opening 22 has a size in which a wall thickness is decreased from the length $L_{mc}$ and the width $W_{mc}$. In a front view of the recovery system 10 that is, a horizontal cross section thereof shown in FIG. 1, the upper housing member 12 is formed in a box shape in which the bottom of trapezoidal shape thereof is opened.

In the illustrated embodiment, the shape of the upper housing member 12 is formed in the trapezoidal shape in the front view as mentioned above, however, instead of such shape, for example, the front elevational shape of the upper housing member 12 may be formed into an upward expanding semicircular shape, and the shape of the upper housing member 12 is not limited to the illustrated embodiment.

The opening 22 provided at the bottom face of the upper housing member 12 may be provided with a flange-shaped presser plate (an upper presser plate) 23 protruding in an outer peripheral direction from an opening edge (three sides except one side in the longitudinal direction in the embodiment shown in FIG. 1), and a space for disposing a rectifying plate 24 mentioned below is secured within a thickness of the upper presser plate 23.

In the illustrated embodiment, the presser plate (the upper presser plate) 23 mentioned above is formed by attaching an appropriately sized plate provided with a rectangular opening having the same size as the bottom face opening of the main body comprising the upper housing member 12 formed in the trapezoidal shape, and the opening formed in the presser plate 23 is turned to the opening 22, in this structure.

The size of the upper housing member 12 can be changed to various sizes depending on the size of the workpiece W which is the subject to be processed, a cut processing width applied thereto, and a processing position of the workpiece W (for example, a cutting process along one side of an end portion of the plate-like two-dimensional workpiece W which is the rectangular plate, or a cutting process applied to a center portion, or the like), however, in the case that the upper housing member 12 is enlarged in size excessively, it is necessary to increase a sucking speed within the upper housing member 12 for recovering the fine abrasive floating therein, accordingly, a large-sized suction means is required. Therefore, such structure is not economical.

As one example, the size of the upper housing member 12 in the illustrated embodiment is set such that the width $W_{mc}$ of the rectangular portion in a plan view is 80 mm, and the length $L_{mc}$ is 200 mm, and the height $H_{mc}$ of the trapezoidal portion in the front view is 109 mm including the thickness of the presser plate (the upper presser plate).

In this case, the rectifying plate 24 is provided within the opening 22 of the upper housing member 12, as shown in FIG. 1, preferably in both sides of the ejection hole 31 of the blast gun 30. In the case that the ejection hole 31 of the blast gun 30 is formed in an elongated rectangular shape as mentioned below, the rectifying plates 24 are provided in both sides of the ejection hole 31 in a width $W_0$ direction of the ejection hole 31, that is, a direction of a short side of the ejection hole 31 (referred to as "a width direction of the ejection hole of the blast gun" in the specification) (See FIGS. 1 and 2), has a length direction in an opening length $L_0$ direction of the ejection hole 31, that is, a direction of a long side of the ejection hole 31 (referred to as "a length direction of the ejection hole of the blast gun" in the specification), and is inclined so as to put distance from said workpiece as far from said ejection hole 31 in its width direction.

In the embodiment shown in FIG. 1, six (6) rectifying plates 24 are provided in one side of the ejection hole 31, accordingly twelve (12) rectifying plates 24 are totally provided in both sides, and are arranged in parallel in such a manner that inclination angles in the width direction become constant.

The rectifying plate 24 provided as mentioned above allows a flow of the abrasives which is going to move along the surface of the workpiece W after being ejected from the ejection hole 31 of the blast gun 30 then bombarded onto the surface of the workpiece W to deflect upward then separate from the surface of the workpiece W (See FIG. 2B), whereby it is possible to securely prevent the fine abrasive from being attached to the surface of the workpiece W by the suction within the space 20 in the upper housing member 12 through the intermediary of the suction devices 21*a* and 21*b* mentioned below, by making the fine abrasives float within the space 20 of the upper housing member 12.

Further, in the structure of the upper housing member 12 shown in FIG. 1, a view window 25 is formed by fitting a transparent glass plate or the like to a front face of the upper housing member 12, thereby a state of the space 20 in the upper housing member 12 can be seen through the intermediary of the view window 25.

It is preferable to provide the view window 25 that it enables to see generation of abnormality within the space 20 in the upper housing member 12, for example, generation of clogging caused by aggregation of the fine abrasive, recovery defect of the abrasive, change of the processing state with respect to the workpiece W and the like, however, the view window 25 is an optional member.

The upper housing member 12 configured as mentioned above is arranged in a state in which the opening 22 formed at the bottom portion thereof is opposed to the surface to be processed of the workpiece W being provided at the predetermined clearance, whereby forming a space surrounded by an inner wall of the upper housing member 12 and the workpiece W to be processed to the negative pressure.

Blast Gun

A leading end portion of the blast gun 30 for ejecting the abrasives to the workpiece W is provided in the upper housing member 12 configured as mentioned above.

The blast gun 30 is attached such that an ejecting direction of the blast gun 30 is in a vertical direction to the workpiece W while passing through a top plate of the upper housing member 12, and the ejection hole 31 is arranged proximity or close to the surface of the workpiece W as shown in FIG. 1 in the illustrated embodiment.

The ejection hole 31 provided in the leading end of the blast gun 30 is formed in an elongated rectangular shape in which the opening width $W_0$ is formed narrow, and is attached to the upper housing member 12 in such a manner that the opening width $W_0$ direction of the elongated rectangular ejection hole 31 is directed to the moving direction T of the workpiece W (See FIGS. 1 and 2).

Figure 2A:
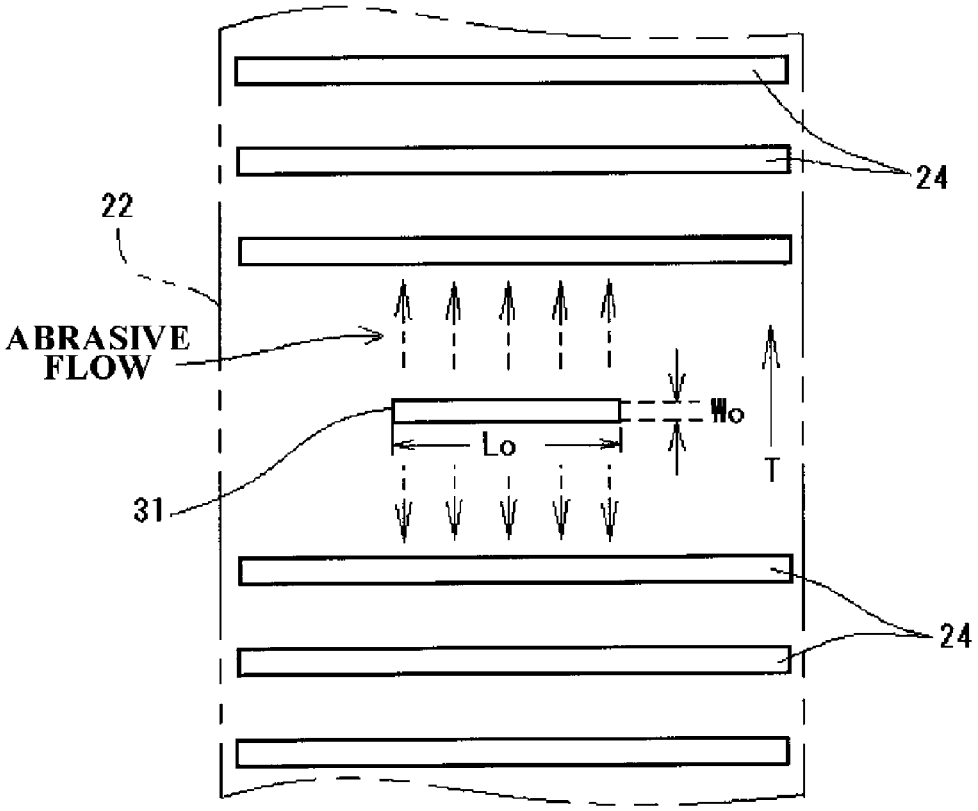
Figure 2B:
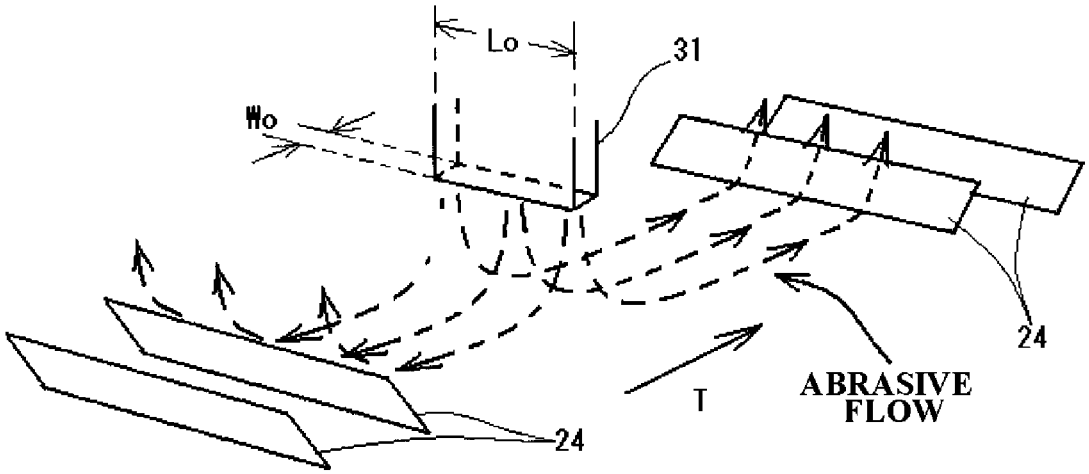

Generally, the abrasives ejected from the blast gun, particularly the fine abrasives easily carried or wafted in a carrier gas flow due to its light weight flows along the surface of the workpiece together with the carrier gas flow when it is bombarded onto the surface of the workpiece. However, in the case that the abrasives are ejected by the blast gun 30 provided with the elongated rectangular ejection hole 31 as mentioned above, it is possible to control the diffusing direction of the abrasives flow after being bombarded onto the surface of the workpiece W to the opening width $W_0$ direction of the ejection hole 31 as shown in FIG. 2A, accordingly, it is possible to prevent the cut width of the workpiece W from being enlarged. In order to obtain such effect more securely, the opening width $W_0$ of the ejection hole 31 is preferably formed in a range within 0.1 mm to 100 mm, more preferably 0.1 mm to 30 mm. In the present embodiment, the rectangular opening of 0.5 mm×15 mm is formed.

As mentioned above, in the case that the fine abrasives are ejected by the blast gun 30 provided with the elongated rectangular ejection hole 31, the distribution of the abrasives on the workpiece corresponds to the ejection hole 31 formed in a shape of the moving direction of the workpiece is a length direction. Thereby, after coming into collision with being bombarded onto the surface of the workpiece W so as to correspond to the ejection hole 31, the ejecting distribution of the abrasives are expanded in the elongated rectangular shape as of width direction of the opening with both ends and the center portion of which are in a circular arc shape and the latter is a narrowed shape in width, respectively. As a result, it is possible to prevent the cut width of the workpiece W from being expanded.

Further, the opening length $L_0$ of the elongated rectangular ejection hole 31 can be formed such a length as to correspond to the processing width with respect to the workpiece W, as one example.

As a matter of fact, in the case that the workpiece W is cut in a predetermined width along one side of the end portion of the workpiece W, the opening length $L_0$ may be formed longer with respect to the cut width. In this case, the position of the workpiece W with respect to the ejection hole 31 or the position of the ejection hole 31 may be adjusted so as to obtain a desired cut width, for example, as shown in FIG. 2A.

Suction Device

The upper housing member 12 mentioned above is further provided with the suction device 21 (21*a* and 21*b*) for sucking the inside of the upper housing member 12. The fine abrasives and the cut scraps floating within the space 20 in the upper housing member 12 can be recovered by sucking the inside of the space 20 through the intermediary of the suction device 21.

The suction device 21 is provided in such a manner as to be opened toward both sides in the opening width $W_0$ direction of the ejection hole 31 of the blast gun 30 (See FIG. 1), and in the illustrated embodiment, the suction devices 21*a* and 21*b* are provided so as to be communicated with the space 20 in the upper housing member 12 while passing through each of inclined surfaces formed at an oblique line portion of the trapezoidal portion in the front view.

Figure 3A:
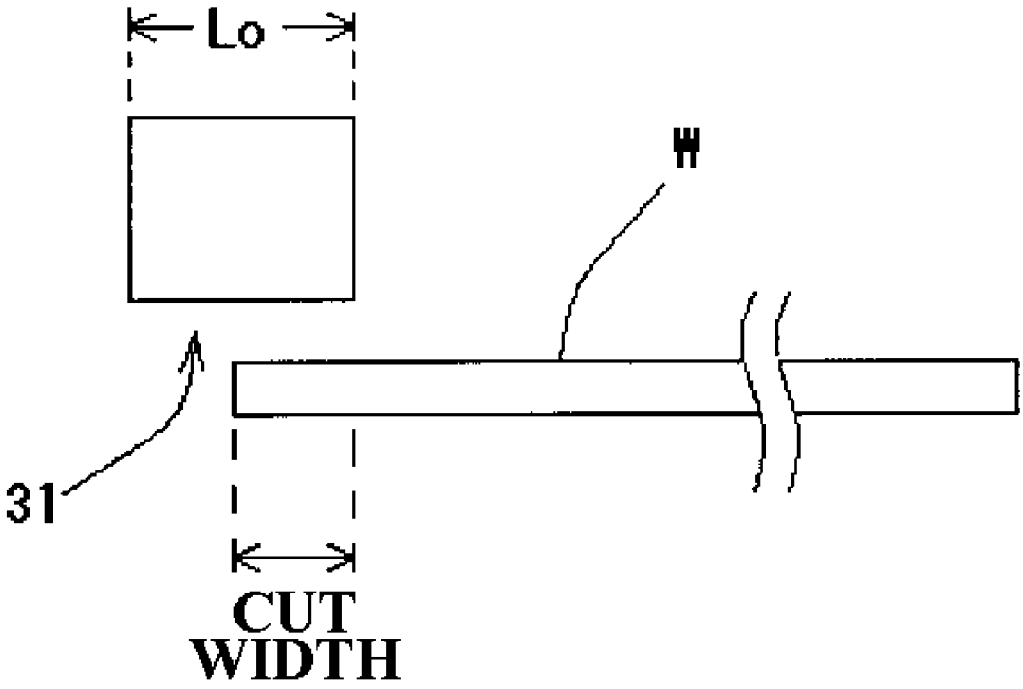
Figure 3B:
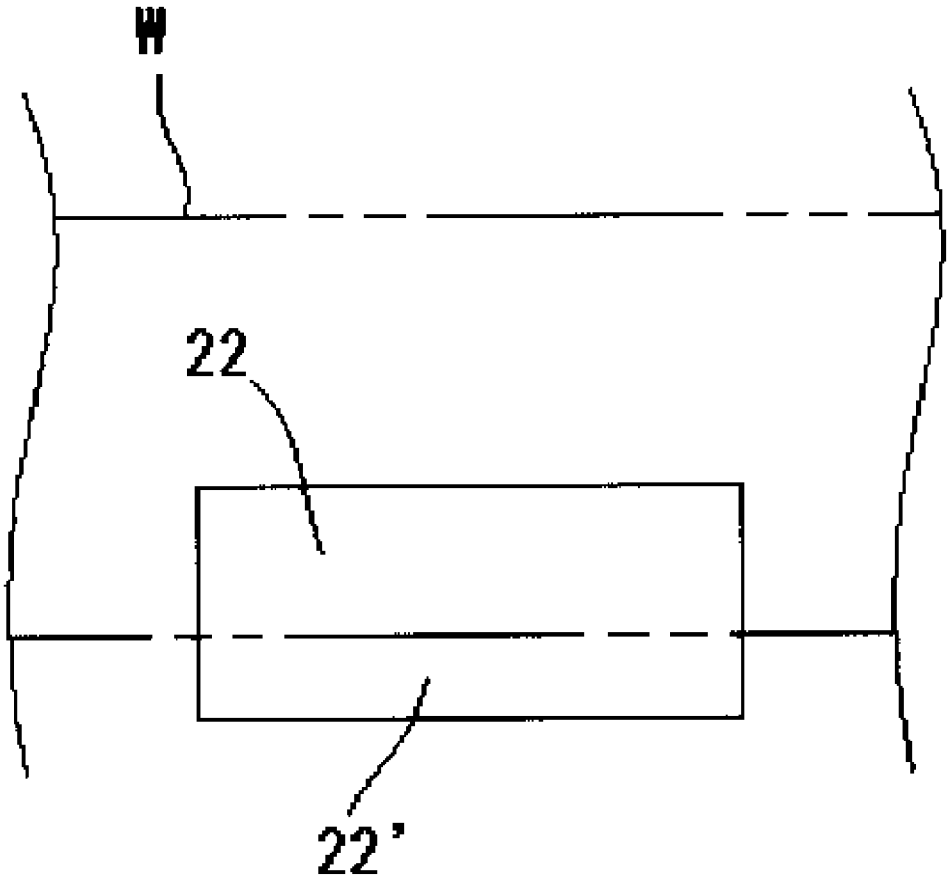
Figure 3C:
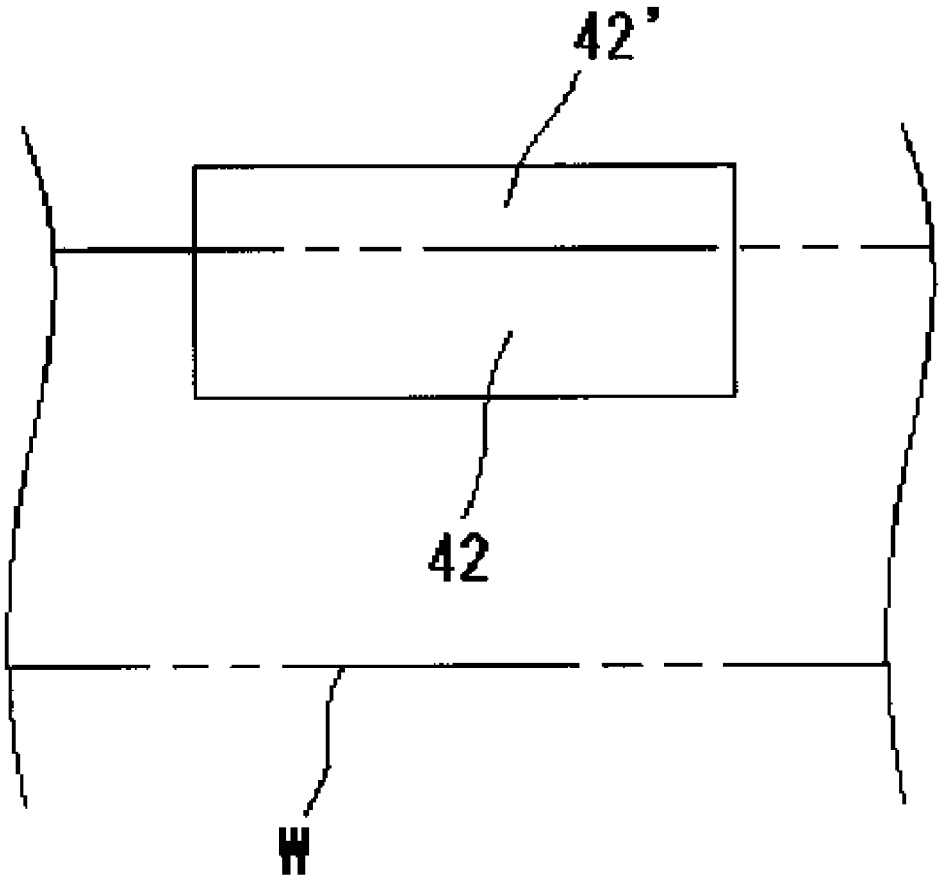
Figure 3D:
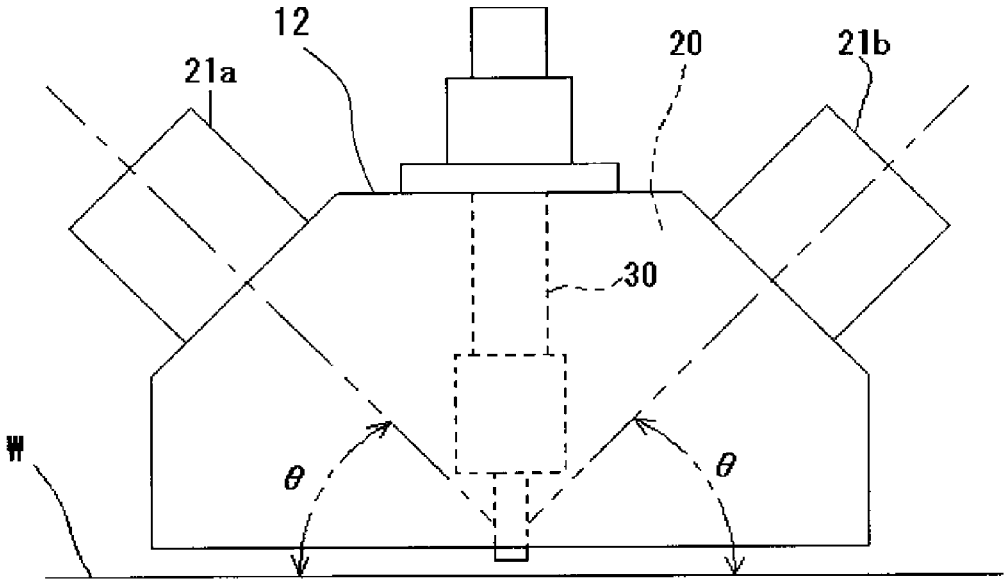

The suction devices 21*a* and 21*b* are preferably installed, as shown in FIG. 3D, such that an angle θ formed by lines obtained by extending axes of the suction devices 21*a* and 21*b*, and the surface to be processed of the workpiece W is in a range within 10 to 80 degree, and are communicated with and opened to the space 20 in the upper housing member 12 while passing through both of the inclined surfaces of the trapezoidal box shape in which the bottom face forming the space 20 is opened in such a manner that the angle θ becomes 45 degree, in the illustrated embodiment. Accordingly, it is possible to more effectively recover the fine abrasives caused by the suction within the space 20 in the upper housing member 12.

In this case, the sizes of the suction devices 21*a* and 21*b* can be changed to various sizes depending on the size of the space 20 in the upper housing member 12, the performance of the used suction means (the dust collector 3 mentioned below) and the like, however, a diameter (an inner diameter) is 47.6 mm as one example, in the illustrated embodiment.

Lower Housing Member

The lower housing member 14 can be arranged so as to oppose to the upper housing member 12 provided with the blast gun 30 and the suction devices 21*a* and 21*b* described above.

The lower housing member 14 has aspace 40 inside, and an opening 42 formed communicate with said space 40 on a top face of the lower housing member 14 in the illustrated embodiment, and the opening 22 formed at the bottom face of the upper housing member 12, and the opening 42 formed on the top face of the lower housing member 14 are provided to oppose each other at a predetermined clearance to allow a movement of the workpiece W to be processed while facing at least one side edge of the opening 22 to at least one side edge of the opening 42.

It is not always necessary to form the opening 22 of the upper housing member 12, and the opening 42 of the lower housing member 14 as the same opening shape, however, in the illustrated embodiment, both are formed into the same shape, and are configured such that opening edges of both the openings 22 and 42 overlap in a plan view.

The lower housing member 14 is formed into a hopper shape as a whole provided with an approximately rectangular tubular portion, and an approximately reverse pyramid shaped portion formed continuously below the rectangular tubular portion, in the embodiment shown in FIG. 1, and is configured such as to be capable of sucking an inside of the lower housing member 14 by communicating the suction device 41 with the lowest end of the reverse pyramid shaped portion.

Further, a lower presser plate 43 is protruded into a flange shape in an outer peripheral direction on an opening edge of the lower housing member 14, in the same manner as the upper housing member 12 mentioned above.

When the spaces 20 in the upper housing member 12 and the space 40 in the lower housing member 14 are communicated with each other by providing the lower housing member 14 opposed to the upper housing member 12, and sucking the inside of the space 40 in the lower housing member 14 as mentioned above, it is possible to recover the fine abrasives ejected within the space 20 in the upper housing member 12 through the intermediary of the space 40 in the lower housing member 14, and it is possible to compensate an upward suction force applied to the workpiece W generated by the suction within the upper housing member 12 by a downward suction force generated by the suction within the lower housing member 14, thereby easily achieving the movement of the workpiece W.

Accordingly, as far as the operation mentioned above can be obtained, the shape of the lower housing member 14, and the formed position, the size and the like of the suction device 41 are not particularly limited.

As a matter of fact, in the structure in which the suction device 41 of the lower housing member 14 is formed in the center of the bottom portion of the lower housing member 14 as is the illustrated embodiment, since the suction device 41 of the lower housing member 14 is disposed ahead of the ejection direction of the blast gun 30, it is possible to efficiently suck and recover the abrasives ejected at a time of carrying out the ejection of the abrasive in a state in which the workpiece W is removed from a front face of the blast gun 30, through the intermediary of the suction device 41 of the lower housing member 14, and there is an advantage that it is possible to rapidly remove and recover the fine abrasives from whichever internal space 20 of the upper housing member 12 and the space 40 of the lower housing member 14.

In this case, in FIG. 1, reference numeral 44 denotes a rectifying plate provided within the opening 42 of the lower housing member 14. The rectifying plate 44 is disposed while setting a width direction thereof to a vertical direction, and forms a downward flow heading for the inside of the lower housing member 14, at a time when the abrasives are recovered within the lower housing member 14 located below.

Other Structures

In this case, since the illustrated recovery system 10 is configured so as to cut one side of the plate-like two-dimensional workpiece W at a predetermined width, an insertion regulating body 51 is provided in a distance formed between the upper housing member 12 and the lower housing member 14, as shown in FIG. 1, and an inserted position of the workpiece W is regulated by the insertion regulating body 51.

Accordingly, the structure is made such that if the workpiece W is inserted between the upper housing member 12 and the lower housing member 14 until one side of the plate-like two-dimensional workpiece W is contacted and engaged with an edge of the insertion regulating body 51, and the workpiece W is moved in a state in which one side of the workpiece W is brought into slidable contact with the insertion regulating body 51, the surface of the workpiece W which is the subject to be processed can pass through the surface of the ejection hole 31 of the blast gun 30.

Further, since a vicinity of one side of the plate-like two-dimensional workpiece W is processed as mentioned above, the upper housing member 12 is connected to the lower housing member 14 by a back plate 52 as shown in FIG. 1, in the manner that a side surface of the opposite side to the insertion side of the workpiece W, and the upper housing member 12 is formed by providing the inclined portion and both side faces of a upper housing member 12 and closing the back face with the back plate 52 and the front face of the upper housing member 12 with the view window 25 made of the glass plate or the like, respectively. However, for example, in the case that the cutting process of the predetermined width is carried out in the center portion of the comparatively large sized plate-like two-dimensional workpiece W while setting the moving direction to the length direction, the insertion regulating body 51 and the back plate 52 may be removed, and the upper housing member 12 and the lower housing member 14 may be disposed in a state of vertically separated into two chambers completely.

Processing Method

The recovery system 10 according to the present invention as mentioned above is configured such that a mixed fluid supply source supplying a mixed fluid of a compressed gas and a fine abrasives are communicated to a rear end portion of the blast gun 30 extended to an outer portion from a top plate of the upper housing member 12.

Further, the structure is made such that the insides of the upper housing member 12 and the lower housing member 14 can be sucked by communicating both the suction device 21 provided in the upper housing member 12, two suction devices 21*a* and 21*b* in this case, and the suction device 41 provided in the lower housing member 14, with the suction means such as the dust collector or the like in the recovery cycle constructed in accordance with the same principle as described in the related art.

Figure 4:
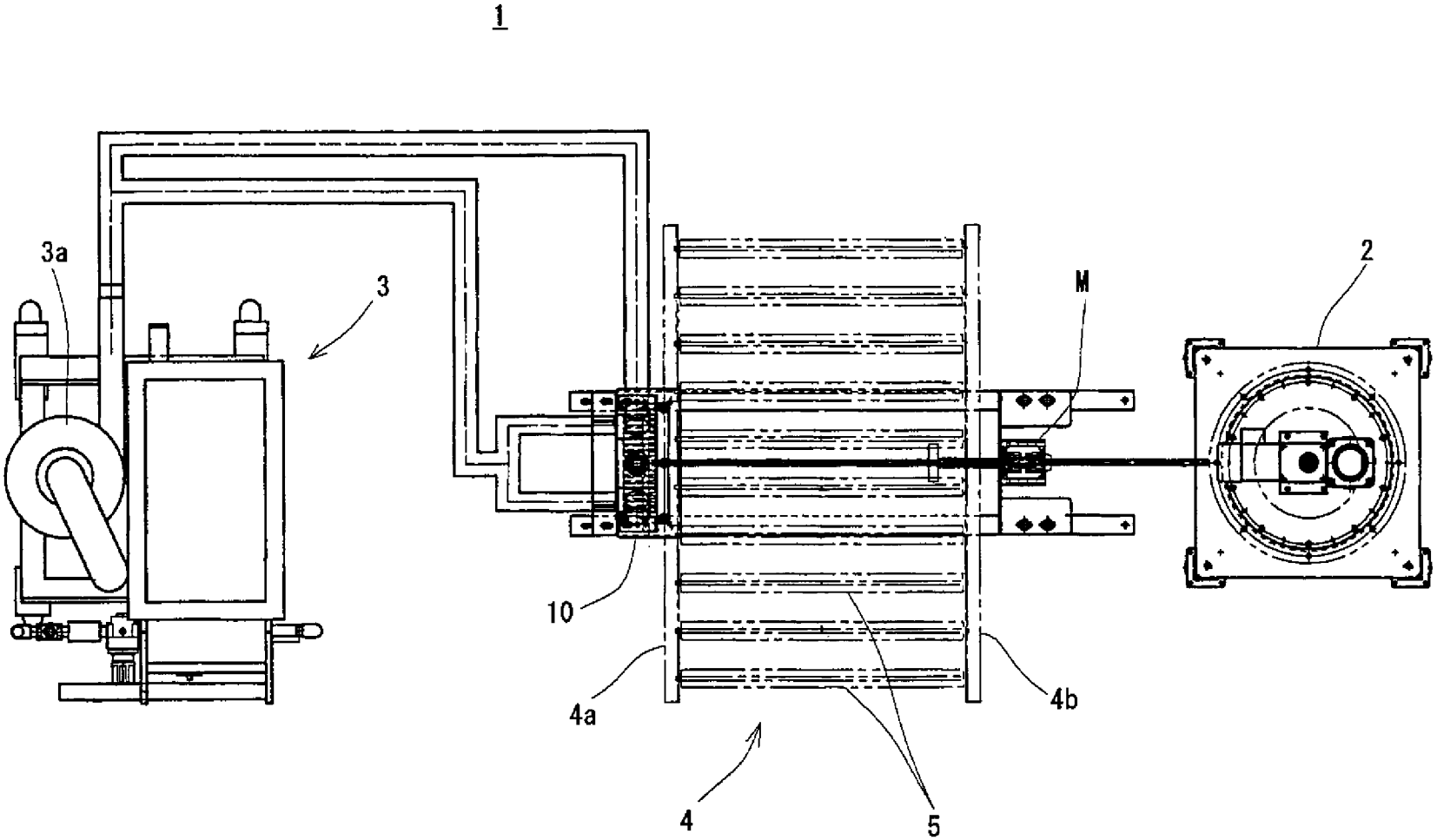
FIG. 4 is a plan view showing a whole structure of a blasting apparatus provided with the abrasive recovery system according to the present invention.

As one example, FIG. 4 shows one structural example of the blasting apparatus 1 provided with the recovery system 10 according to the present invention mentioned above, and the rear end portion of the blast gun 30 provided in the recovery system 10 according to the present invention is communicated with a pressurizing tank 2 quantitatively feeding the fine abrasives as the mixed fluid with the compressed gas to the blast gun while weighing at a fixed amount.

Further, all of two suction devices 21*a* and 21*b* provided in the upper housing member 12, and the suction device 41 provided for the lower housing member 14 are communicated with the common dust collector 3 which is the suction means, whereby it is possible to suck an ambient air within each of the space 20 in the upper housing member 12 and the space 40 in the lower housing member 14 so as to keep the ambient air under the negative pressure.

The fine abrasives within the upper housing member 12 and the lower housing member 14 recovered by the dust collector 3 is sorted into a reusable abrasives and the cut scraps by a cyclone 3*a* provided in the dust collector 3 so as to be recovered, and the reusable abrasives can be reused by being charged again into the pressurizing tank 2.

Figure 5:
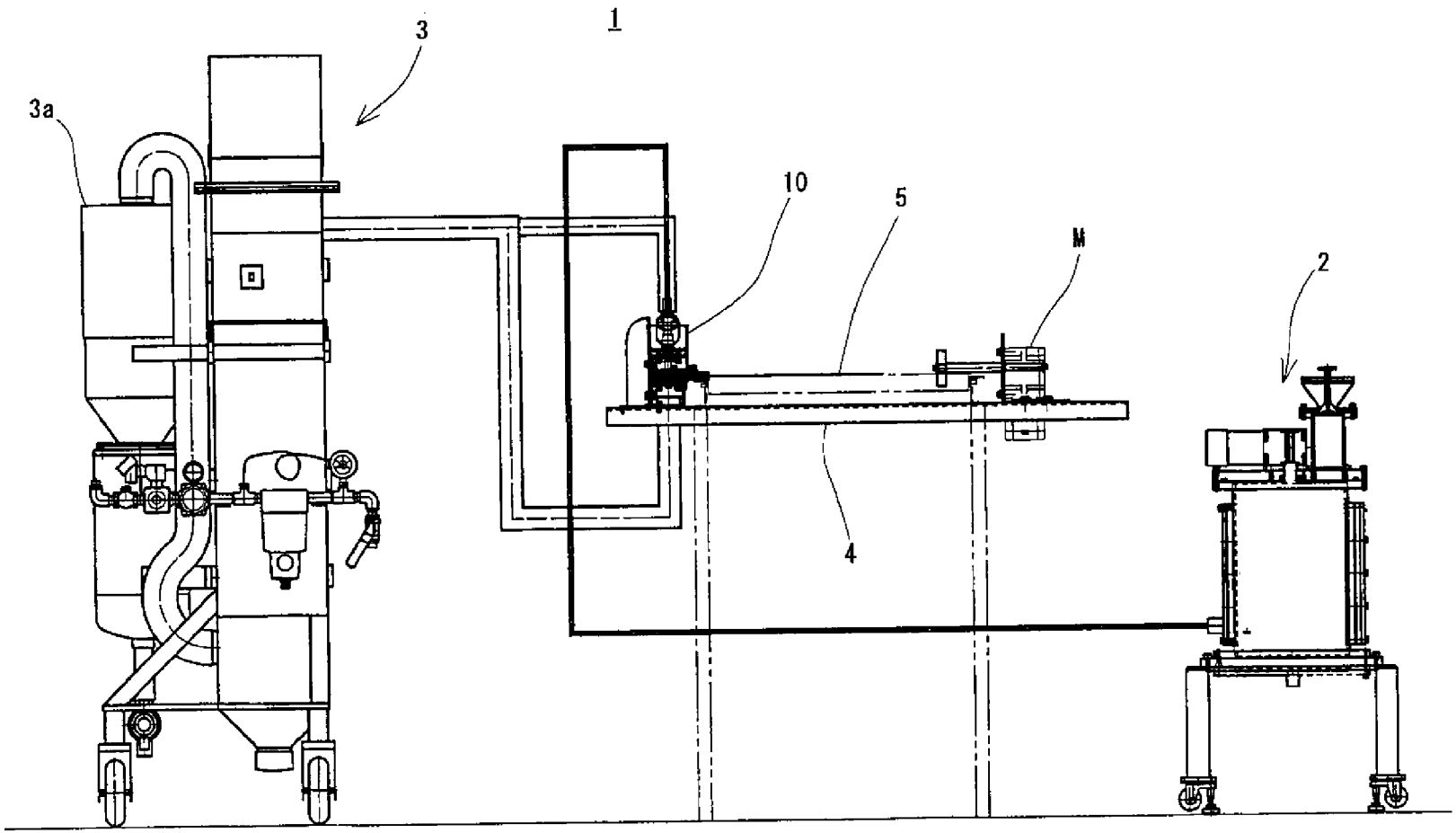
FIG. 5 is a front view of FIG. 4.

In this case, in the illustrated embodiment, reference numeral 4 in FIGS. 4 and 5 denotes a conveyor table. A carrier roller 5 provided on the conveyor table 4 is rotated by a rotation of a drive motor M, and the workpiece W mounted thereon can be carried in a predetermined direction.

In the illustrated embodiment, the vicinity of one side of the end portion of the workpiece W passes between the upper housing member 12 and the lower housing member 14, by attaching the upper housing member 12 and the lower housing member 14 constructing the recovery system 10 according to the present invention to the one side 4*a* of the conveyor table in which the carrier direction of the workpiece W is set to the longitudinal direction, and moving the workpiece W mounted on the carrier roller 5 of the conveyor table 4, however, on the contrary thereto, a relative movement with respect to the workpiece W can be achieved by fixing the workpiece W, and transferring the upper housing member 12 and the lower housing member 14 constructing the recovery system 10 according to the present invention.

Figure 6A:
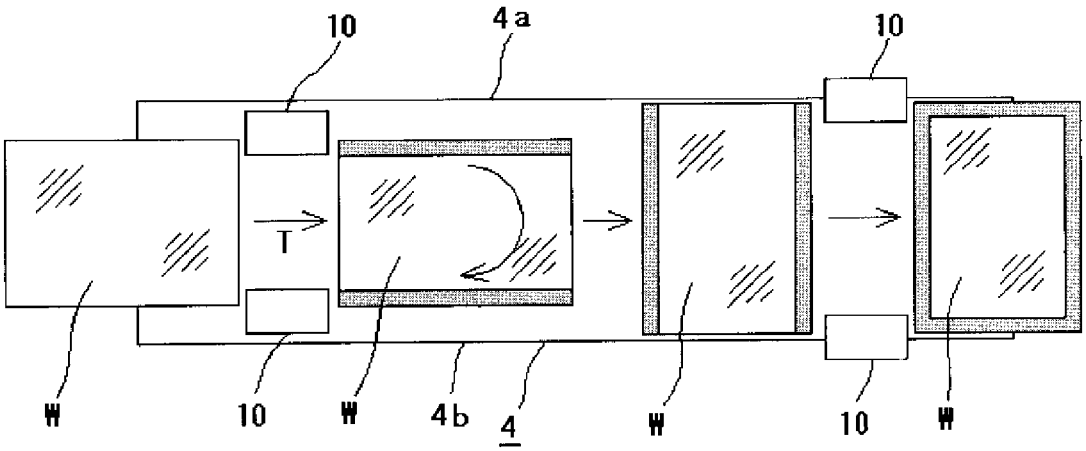
Figure 6B:
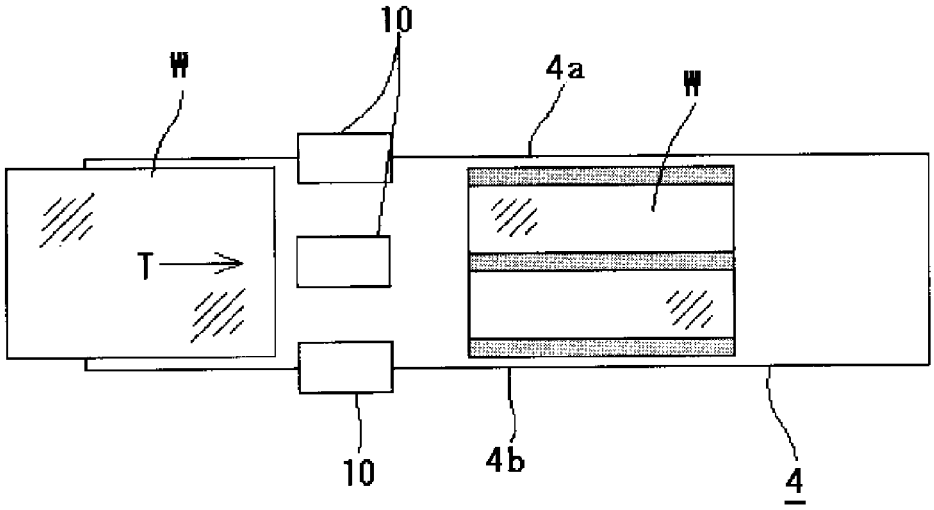
Figure 7:
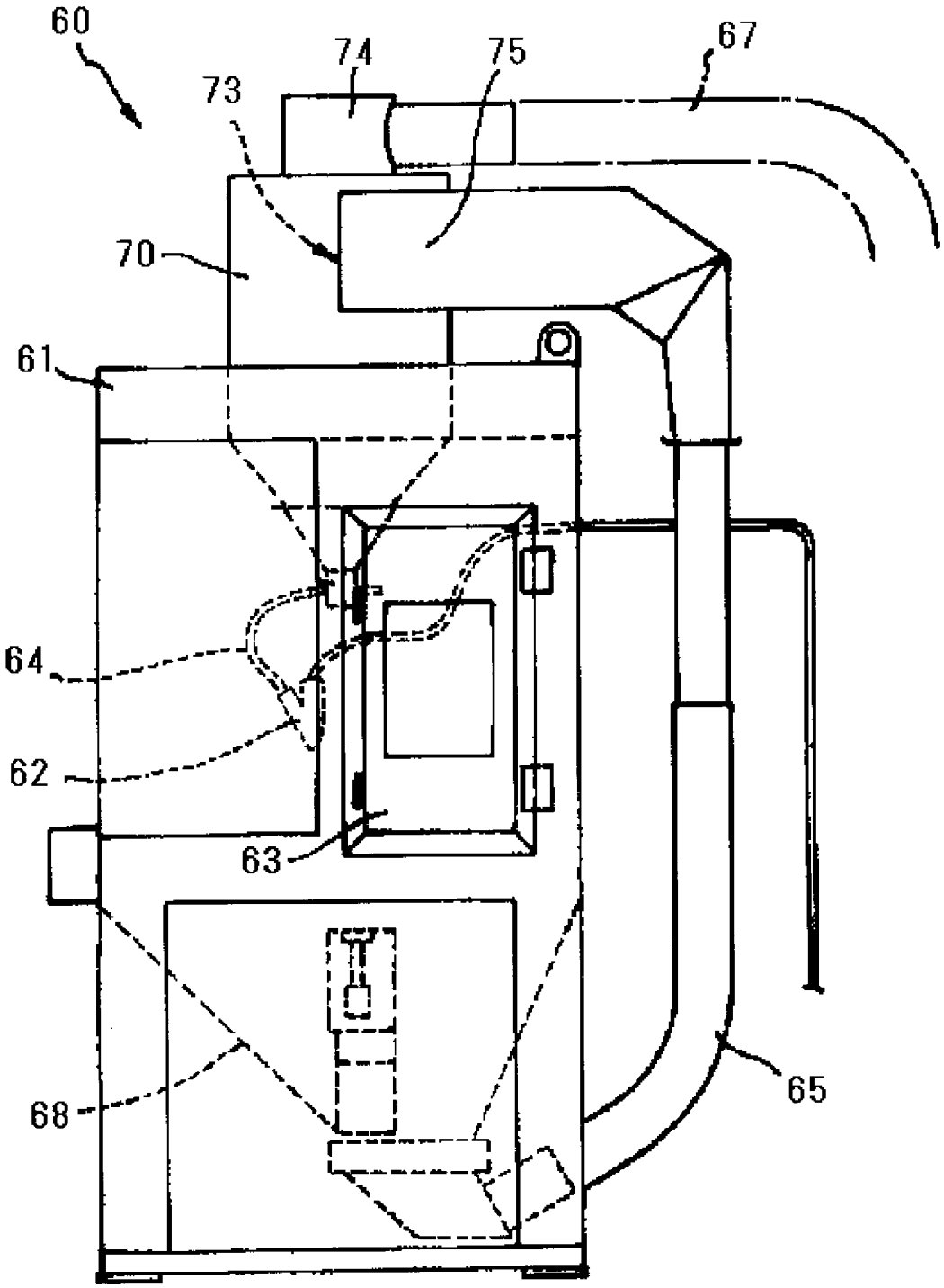
FIG. 7 is an explanatory view of a conventional apparatus (of a gravity type)
Figure 8:
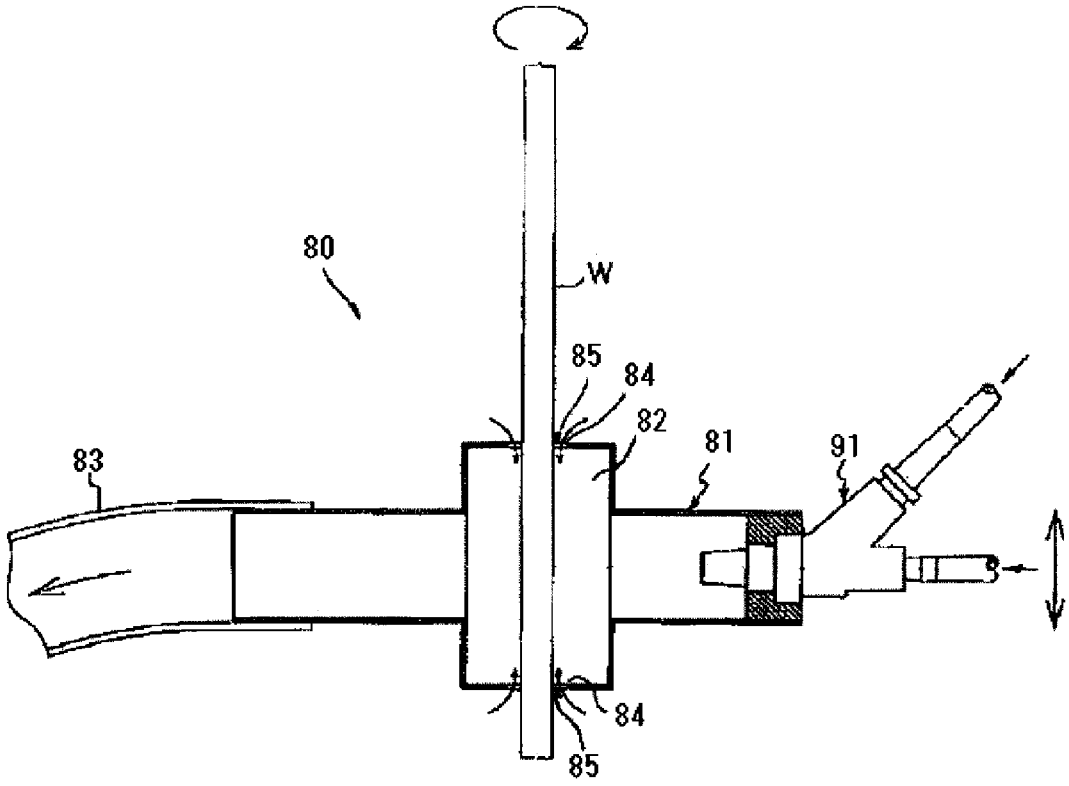
FIG. 8 is an explanatory view of a conventional apparatus (of Japanese Patent LOPI No. H09-300220)
Figure 9A:
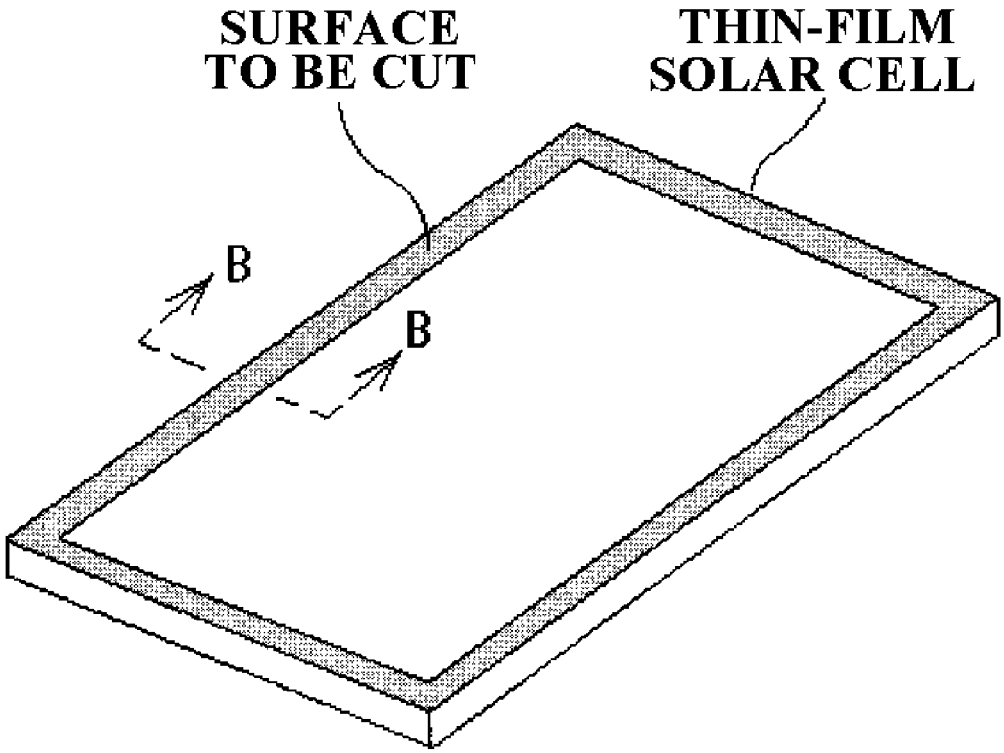
Figure 9B:
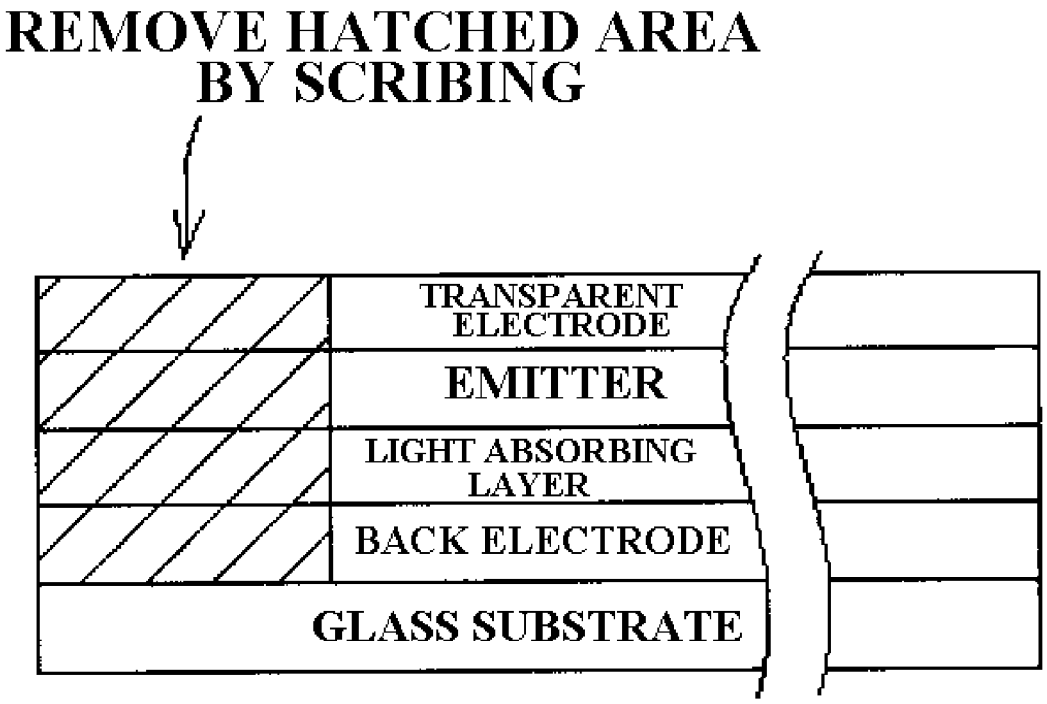

Further, in the illustrated embodiment which can process the predetermined width in one side of the end portion of the workpiece W, the recovery system 10 according to the present invention is provided only on the one side 4*a* side of the conveyor table 4, however, for example, in the case of simultaneously processing each of two parallel sides of the workpiece W, the recovery system 10 may be provided on the other side 4*b* of the roller conveyor thereby two sides of the workpiece can be processed simultaneously by carrying only one time. Further, as shown in FIG. 6A, for example, four (4) sides of the workpiece may be processed by a continuous work accompanying the rotation of the workpiece W. Further, as shown in FIG. 6B, the recovery system 10 may be disposed at a position through which the center portion of the workpiece W passes, thereby the blasting process can be applied to the center portion and the other optional positions as well as the end line portion of the workpiece W.

At a time of using, a predetermined clearance is provided between the surface to be processed of the workpiece W and the bottom face of the upper housing member 12, and the back face of the workpiece and the top face of the lower housing member 14, by regulating the distance between the upper housing member 12 and the lower housing member 14, the distance between the workpiece W and each of the upper housing member 12 and the lower housing member 14, and the height of the blast gun 30 depending on the thickness of the plate-like two-dimensional workpiece which is the subject to be processed.

An outside air is introduced into the upper housing member 12 and the lower housing member 14 through the intermediary of this portion at a time of sucking the gas within both spaces in the upper housing member 12 and the lower housing member 14, by providing the distance as mentioned above, and the fine abrasives are prevented from scattering to the negative pressure space. Further, since the outside air is introduced along the surface of the workpiece W, it is possible to make the fine abrasives intending to be attached to the surface of the workpiece W float by the outside air flow.

As one example, in the case that the plate-like two-dimensional workpiece W which is the subject to be processed is a plate glass having a thickness 3 mm, intervals of the respective portions are as follows. In the illustrated embodiment, a clearance between the upper housing member 12 and the lower housing member 14 (a clearance between the upper presser plate 23 and the lower presser plate 43 in the illustrated embodiment) is 7 mm, a clearance between the plate-like two-dimensional workpiece W and the upper housing member 12 (the upper presser plate 23) is 2 mm, and an interval between the plate-like two-dimensional workpiece W and the lower housing member 14 (the lower presser plate 43) is 1 mm. Further, in the illustrated embodiment in which the rectifying plate 24 is provided within the opening 22 of the upper housing member 12, a clearance between the rectifying plate 24 and the plate-like two-dimensional workpiece W is 0.9 mm, and a clearance between the blast gun 30 and the plate-like two-dimensional workpiece W can be set to 3 mm.

If the abrasives are ejected from the blast gun 30 in a state in which the piping connection to each of the devices and the interval regulation of each of the devices are finished in the manner as mentioned above, and the workpiece W is inserted and passed between the upper housing member 12 and the lower housing member 14 while sucking the insides of the space 20 in the upper housing member 12 and the space 40 in the lower housing member 14 by three suction devices 21*a*, 21*b* and 41, the workpiece W is cut continuously in the moving direction T, at a width which is the opening length $L_0$ of the elongated rectangular formed ejection hole 31 formed in the blast gun 30.

Figure 10:
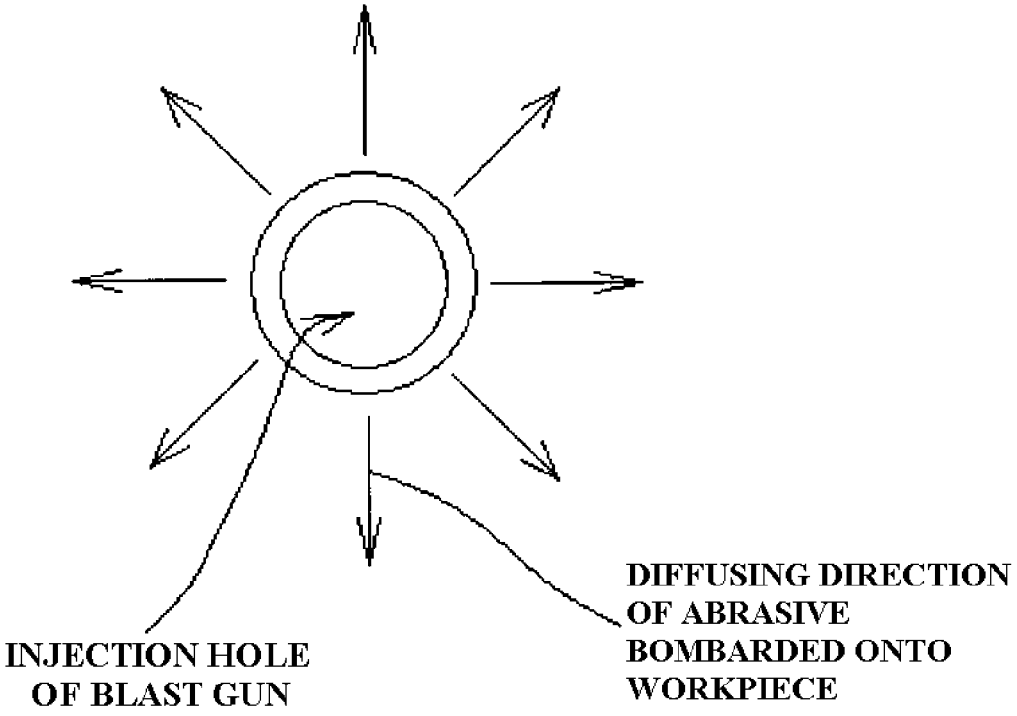
FIG. 10 is an explanatory view showing a diffusion state of the abrasive by a blast gun (with a round ejection hole).

In the case of using the blast gun provided with the circular ejection hole which is generally used, the ejected abrasives generate a flow moving along the surface of the workpiece in all the directions, i.e., 360 degree as shown in FIG. 10, after being bombarded onto the workpiece, however, the abrasives ejected from the blast gun 30 provided with the ejection hole 31 formed into the elongated rectangular shape as mentioned above, particularly the comparatively narrow elongated rectangular shape having the opening width $W_0$ within 0.1 mm to 3 mm, generates the flow along the surface of the workpiece W in the opening width $W_0$ direction of the ejection hole 31, and no diffusion of the abrasives are generated in the opening length $L_0$ direction.

Accordingly, the workpiece W can be cut at the corresponding width to the opening length $L_0$ of the ejection hole 31, by using the blast gun 30 provided with the elongated rectangular formed ejection hole 31 as mentioned above.

Further, the abrasives flow moving on the surface of the workpiece W in the opening width $W_0$ direction of the ejection hole 31 as mentioned above is thereafter deflected into an obliquely upward flow by the rectifying plate 24 provided in the opening 22 of the upper housing member 12 in such a manner as to separate from the surface of the workpiece W (referred to FIG. 2B), and accordingly, the abrasives float in the space within the upper housing member 12.

Since the abrasives which is #400 or more, or has an average diameter 30 μm or less, that is, the fine abrasives used in the present invention, has a long flight duration at a time of floating, and tends to ride on the gas flow, the abrasives can be easily recovered together with the gas in the field in the floating state. Accordingly, the abrasives in the floating state mentioned above can be recovered together with the gas within the upper housing member 12 by the suction from the suction devices 21*a* and 21*b* mentioned above. Once the abrasives or the like is attached to the surface to be processed of the workpiece W, it is impossible to peel or fall away it by the after blow and the water washing is required, as mentioned above. However, according to the present invention, it is possible to easily recovery the abrasives before being attached.

The space within the upper housing member 12 becomes negative pressure at a time of recovering the abrasives carried out as mentioned above, and the workpiece W is sucked upward by the negative pressure, however, the downward suction force is simultaneously applied to the workpiece W by the suction within the lower housing member 14 opposed to the upper housing member 12. As a result, the workpiece easily passes through each of the openings 22 and 42 opposed by being spaced each other at the fixed interval between the upper housing member 12 and the lower housing member 14 depending on a balance between the both.

Preferably, the downward suction force generated in the lower housing member 14 is equal to or larger than the upward suction force generated in the upper housing member 12, by forming the clearance between the workpiece W and the lower housing member 14 narrower than the interval between the workpiece W and the upper housing member 12. Accordingly, by pressing the workpiece W against the carrier roller 5 of the conveyor table 4, for example, in the case that the plate-like two-dimensional workpiece W is the thin-film solar cell panel or the like, it is possible to avoid the generation of such a problem that each of the thin film layers formed on the glass substrate is damaged due to the contact with the upper presser plate 23.

In the case of processing the one side end portion of the plate-like two-dimensional workpiece W such as the illustrated embodiment, a position of the end portion of the workpiece W is regulated by the insertion regulating body 51 at a time of cutting the workpiece W. As a result, the opening 22 of the upper housing member 12 and the opening 42 of the lower housing member 14 are communicated with each other through the intermediary of recovery openings 22' and 42' of which is not facing to the workpiece W as shown in FIGS. 3B and 3C.

As a result, the fine abrasives ejected from the blast gun 30, and the cut scraps generated by ejecting the fine abrasives are sucked and recovered by the dust collector through the intermediary of the suction devices 21*a* and 21*b* sucking the inside of the upper housing member 12, as well as the fine abrasives and the cut scraps within the upper housing member 12 are sucked and recovered through the intermediary of the space within the space 40 in the lower housing member 14 and the recovery openings 42' and 22' by the suction member (the dust collector) sucking the inside of the lower housing member 14 through the suction device 41, so that the fine abrasives and the cut scraps within both the upper housing member 12 and the lower housing member 14 are efficiently recovered in the floating state before being attached to the surface of the workpiece W.

As a result, the pressure space 40 in the lower housing member 14 and the suction device 41 share the recovery of the fine abrasives and the cut scraps floating within the upper housing member 12 together with the suction devices 21*a* and 21*b*, efficiently recover the fine abrasives entered to the back face side of the workpiece W, and effectively prevent the attachment of the fine abrasives on the back face of the workpiece W.

Further, if the workpiece W is removed from the clearance between both the spaces in the upper housing member 12 and the lower housing member 14 by the movement of the workpiece W, both the spaces 20, 40 are communicated with each other through the intermediary of a whole surfaces of the opening 22 of the upper housing member 12 and the opening 42 of the lower housing member 14, the fine abrasives ejected by the blast gun 30 is directly introduced into the lower housing member 14 then immediately recovered. As a result, the fine abrasives are prevented from collecting within the upper housing member 12 and the lower housing member 14 even in the state in which no workpiece W is existed between both the upper housing member 12 and the lower housing member 14.

On the other hand, in the case that the upper housing member 12 and the lower housing member 14 are completely separated therebetween by the workpiece W such as the case that the process is applied, for example, to the center portion of the comparatively large-sized workpiece W, the abrasives ejected from the blast gun is recovered only through the intermediary of the suction devices 21*a* and 21*b* communicated with the space 20 in the upper housing member 12 at a time when the workpiece W is interposed, and the suction within the space 40 in the lower housing member 14 works only for sucking the workpiece W downward. However, if the space 20 in the upper housing member 12 is communicated with the space 40 within the lower housing member 14 by the movement of the workpiece W, the abrasives ejected from the blast gun 30 is sucked and recovered through the intermediary of the lower housing member 14 and the suction device 41.

As mentioned above, in the recovery system 10 according to the present invention provided with the structure mentioned above, it is possible to prevent the fine abrasives from being attached to the surface of the workpiece W at a time of the cutting process, and it is possible to carry out the cutting process with the predetermined width without sticking the mask to the workpiece W. Accordingly, the blasting process using the fine abrasives can be applied even to the workpiece which can not be washed with the washing water and can not be stuck the mask for example, such as the case of scribing the thin film formed on the glass substrate of the thin-film solar cell panel.

Further, even in the case that the process is applied to the workpiece which can be washed after the blasting process and can be stuck the mask, it is possible to omit the labor expended in the washing and the sticking of the mask, and the use of the resources such as the mask, the washing fluid and the like used for this work, and it is possible to widely reduce the cost of the cutting process.

Further, in the case that no workpiece W is existed between both the upper housing member 12 and the lower housing member 14 such as before disposing the workpiece W between both the upper housing member 12 and the lower housing member 14, or after the workpiece W passes between both the upper housing member 12 and the lower housing member 14, and the like, the fine abrasives ejected by the blast gun 30 is rapidly removed from the spaces 20 and 40 by the suction by the space 40 in the lower housing member 14, and is fed to the recovery cycle, accordingly no fine abrasives are collected in the space 20 in the upper housing member 12.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A blasting method, comprising the steps of:

providing an upper housing member having a space inside and an opening communicating with said space at a bottom face located at a lower extent of the upper housing;

positioning said upper housing member above a workpiece, so as to arrange the opening of the upper housing member facing toward a surface of said workpiece, and to make a predetermined clearance between the bottom face of the upper housing member and the surface of said workpiece;

providing a blast gun having an ejection hole with an elongated rectangular cross sectional shape, with the rectangular cross sectional shape having an opening width measured on a width direction line and an opening length measured on a length direction line transverse to the width direction line, in the upper housing member so that said ejection hole is disposed proximity to said surface of said workpiece to be processed through said opening of said upper housing member, and the ejecting direction of said blast gun is approximately vertical to said workpiece;

providing rectifying plates in said upper housing at locations that are adjacent to each of the two opposed sides of said blast gun that are located on the width direction line, with plural rectifying plates being adjacent to each of the opposed sides of said blast gun and all of the plural rectifying plates being symmetrically inclined at a same angle relative to vertical for deflecting a flow of abrasives along a surface of said workpiece so that said flow of said abrasives are moved away from said surface of said workpiece;

moving said workpiece by a carrier means relatively with respect to the blast gun with keeping a clearance between the bottom face of the upper housing member and the surface of said workpiece;

ejecting a mixed fluid of a compressed gas and abrasives in an elongated rectangular shape according to a cross sectional shape of said ejection hole to said surface of said workpiece to be processed from an ejection hole of said blast gun; and providing suctioning means to create negative pressure within the space in the upper housing member, including providing suctioning means ducts at each of two opposed sides of the blast gun, with the two opposed sides being located on the width direction line of the ejection hole, to make the space negative pressure for recovering cut scraps of said workpiece and abrasives from said surface of said workpiece through the opening and the space of said upper housing member.

2. The blasting method according to claim 1, further comprising the steps of:

providing a lower housing member having a space inside and an opening communicating with said space at a top face thereof;

positioning said lower housing member under the workpiece so as to arrange the opening of the lower housing member facing toward the opening of said upper housing member through said workpiece, and to make a predetermined clearance between the top face of the lower housing member and a back surface of said workpiece;

suctioning the space in said lower housing member by said suction means to make the space negative pressure for recovering cut scraps and abrasives through the opening and the space of said lower recovery member.

3. The blasting method according to claim 1, wherein said relative moving direction of said workpiece with respect to said ejection hole is aligned to be parallel with the width direction line of said ejection hole.

4. The blasting method according to claim 1, wherein a width of said ejection hole of said blast gun, as measured along the width direction line, is within 0.1 mm to 100 mm.

5. The blasting method according to claim 1, wherein the suctioning of the space in the upper housing member is carried out with at least one suction device duct that is oriented at an angle within 10 to 80 degree with respect to said said bottom face of the upper housing.

6. The blasting method according to claim 1, wherein said workpiece is a thin-film solar cell panel having thin film layers which are a back electrode, a light absorbing layer, an emitter, a transparent electrode, on a glass substrate, and said thin film layers and said abrasives cut and removed from said glass substrate are sucked and recovered through the space in said upper housing member.

7. The blasting method according to claim 1, wherein said workpiece to be processed is a thin-film solar cell panel having thin film layers which are selected from a back electrode, a light absorbing layer, an emitter, and a transparent electrode on a glass substrate, and said thin film layers and said abrasives cut and removed from said glass substrate are sucked and recovered through the space in said upper housing member at a time of dividing said panel into each of the cells.

8. A blasting apparatus provided with an abrasive recovery system, comprising:

an upper housing member having a space inside, an opening communicating with said space at a bottom face located at a lower extent of the upper housing and a suction device of which one end communicating with said space in said upper housing member to create negative pressure within the space in the upper housing;

said upper housing member positioned above a workpiece so as to arrange the opening of the upper housing member facing toward a surface of said workpiece, and to make a predetermined clearance between the bottom face of the upper housing member and the surface of said workpiece;

a blast gun provided in said upper housing member for ejecting a mixed fluid of a compressed gas and abrasives to said surface of said workpiece and said work piece being provided so as to be moved by a carrier means relatively with respect to said blast gun with keeping said clearance between the bottom face of the upper housing member and the surface of the workpiece to be processed, said blast gun having an ejection hole formed as an elongated rectangular cross sectional shape, with the rectangular cross sectional shape having an opening width measured on a width direction line and an opening length measured on a length direction line transverse to the width direction line, and being disposed at a proximity to said surface of said workpiece through said opening of said upper housing member so that ejecting direction of said blast gun is approximately vertical to said workpiece;

rectifying plates provided in said upper housing at locations that are adjacent to each of the two opposed sides of said blast gun that are located on the width direction line, with plural rectifying plates being adjacent to each of the opposed sides of said blast gun and all of the plural rectifying plates being symmetrically inclined relative to vertical at a same angle for deflecting a flow of abrasives along a surface of said workpiece so that said flow of said abrasives are moved away from said surface of said workpiece;

said suction device of said upper housing member comprising two ducts, with the ducts being located at each of two opposed sides of the blast gun, with the two opposed sides being on the width direction line of the ejection hole such that the two ducts are opened toward each of two opposed sides of said ejection hole that are located along the width direction line of the ejection hole, and suction means communicating with the other end of said suction device, said suction means suctioning said space in said upper housing member to make the space negative pressure, and recovering cut scraps of said workpiece and abrasives from said surface of said workpiece.

9. The blasting apparatus provided with an abrasive recovery system according to claim 8, further comprising:

a lower housing member having a space inside, an opening communicating with said space on a top face thereof, and a suction device of which one end communicating with said space in said lower housing member, and the other end communicating with a suction means;

said lower housing member positioned under the workpiece so as to arrange the opening of the lower housing member facing toward the opening of said upper housing member through said workpiece, and to make a predetermined clearance between the top face of the lower housing member and a back surface of said workpiece;

said suction means communicating with the other end of said suction device for suctioning said space in said lower housing member to make the space negative pressure, and recovering cut scraps of said workpiece and abrasives from said workpiece through said lower housing member.

10. The blasting apparatus provided with an abrasive recovery system according to claim 8, wherein the width direction line of said ejection hole of said blast gun is aligned to be parallel with said relative moving direction of said workpiece.

11. The blasting apparatus provided with an abrasive recovery system according to claim 8, wherein said width of said ejection hole of said blast gun, as measured along the width direction line, is within 0.1 mm to 100 mm.

12. The blasting apparatus provided with an abrasive recovery system according to claim 8, wherein an axis of at least one of said ducts with respect to said bottom face of the upper housing is set to an inclination angel within 10 to 80 degree.

13. The blasting apparatus provided with an abrasive recovery system according to claim 12, wherein rectifying plates are provided in said upper housing at locations that are at each of the two opposed sides of said blast gun that are located along the width direction line and symmetrically inclined at a same angle for deflecting a flow of abrasives along said surface of said workpiece so that said flow of said abrasives are moved away from said surface of said workpiece.

14. The blasting apparatus according to claim 8, wherein said workpiece to be processed is a thin-film solar cell panel having thin film layers which are selected from a back electrode, a light absorbing layer, an emitter, and a transparent electrode on a glass substrate, and said thin film layers and said abrasives cut and removed from said glass substrate are sucked and recovered through the space in said upper housing member.

15. The blasting apparatus according to claim 8, wherein said workpiece to be processed is a thin-film solar cell panel having thin film layers which are selected from a back electrode, a light absorbing layer, an emitter, and a transparent electrode on a glass substrate, and said thin film layers and said abrasives cut and removed from said glass substrate are sucked and recovered through the space in said upper housing member at a time of dividing said panel into each of the cells.

* * * * *